US010987525B2

(12) United States Patent
Kils et al.

(10) Patent No.: US 10,987,525 B2
(45) Date of Patent: Apr. 27, 2021

(54) DESCENDING APPARATUS AND METHODS FOR USE OF SAME

(71) Applicant: CMC RESCUE, INC., Goleta, CA (US)

(72) Inventors: Ole Kils, Goleta, CA (US); Tyler J. Mayer, Carpinteria, CA (US)

(73) Assignee: CMC Rescue, Inc., Goleta, CA (US)

( * ) Notice: Subject to any disclaimer, the term of this patent is extended or adjusted under 35 U.S.C. 154(b) by 203 days.

(21) Appl. No.: 15/986,599

(22) Filed: May 22, 2018

(65) Prior Publication Data

US 2018/0333596 A1 Nov. 22, 2018

Related U.S. Application Data

(60) Provisional application No. 62/509,284, filed on May 22, 2017.

(51) Int. Cl.
*A62B 1/10* (2006.01)
*A62B 1/14* (2006.01)

(52) U.S. Cl.
CPC . *A62B 1/10* (2013.01); *A62B 1/14* (2013.01)

(58) Field of Classification Search
CPC .... A62B 1/00; A62B 1/06; A62B 1/08; A62B 1/10; A62B 1/14; A62B 1/18; A62B 1/20; A62B 35/0081
See application file for complete search history.

(56) References Cited

U.S. PATENT DOCUMENTS 950,702 A * 3/1910 O'Brien ..... D06F 53/00 24/133
2,845,674 A * 8/1958 Pearson ..... F16G 11/106 24/134 KB
4,596,314 A * 6/1986 Rogelja ..... A62B 1/14 182/5
5,850,893 A * 12/1998 Hede ..... A62B 1/14 182/193
7,866,634 B2 * 1/2011 Lipke ..... F16G 11/046 254/389
8,925,680 B2 1/2015 Herrli
10,092,781 B2 * 10/2018 Malcolm ..... A62B 1/14
2002/0017428 A1 * 2/2002 Mauthner ..... A62B 1/14 182/5
2003/0075392 A1 * 4/2003 Rogelja ..... A62B 1/14 188/65.5
2006/0207829 A1 * 9/2006 Mauthner ..... A62B 1/14 182/5
2007/0215411 A1 * 9/2007 Petzl ..... A62B 1/14 182/193
2011/0011672 A1 * 1/2011 Price, Jr. ..... A62B 1/14 182/5
2011/0315480 A1 * 12/2011 Maurice ..... A62B 1/14 182/193
2012/0012422 A1 * 1/2012 Herrli ..... A62B 1/14 182/5
2012/0103725 A1 * 5/2012 Johansson ..... A62B 1/14 182/5
2013/0313047 A1 * 11/2013 Chaumontet ..... A62B 35/00 182/241

(Continued)

*Primary Examiner* — Daniel P Cahn
*Assistant Examiner* — Shiref M Mekhaeil
(74) *Attorney, Agent, or Firm* — McCoy Russell LLP

(57) ABSTRACT

Methods and systems are provided for a rappelling device comprising a body, a pocket, and a pivotable bollard.

12 Claims, 11 Drawing Sheets

(56) References Cited

U.S. PATENT DOCUMENTS

| | | | | |
|---|---|---|---|---|
| 2016/0287913 | A1* | 10/2016 | Bell | A62B 1/14 |
| 2017/0050055 | A1* | 2/2017 | Spydell, Jr. | A62B 1/14 |
| 2019/0099626 | A1* | 4/2019 | Codega | A62B 1/14 |
| 2019/0224503 | A1* | 7/2019 | Malcolm | A62B 1/14 |
| 2019/0314651 | A1* | 10/2019 | Chabod | A62B 1/14 |
| 2019/0351264 | A1* | 11/2019 | Ratalino | A62B 1/14 |

* cited by examiner

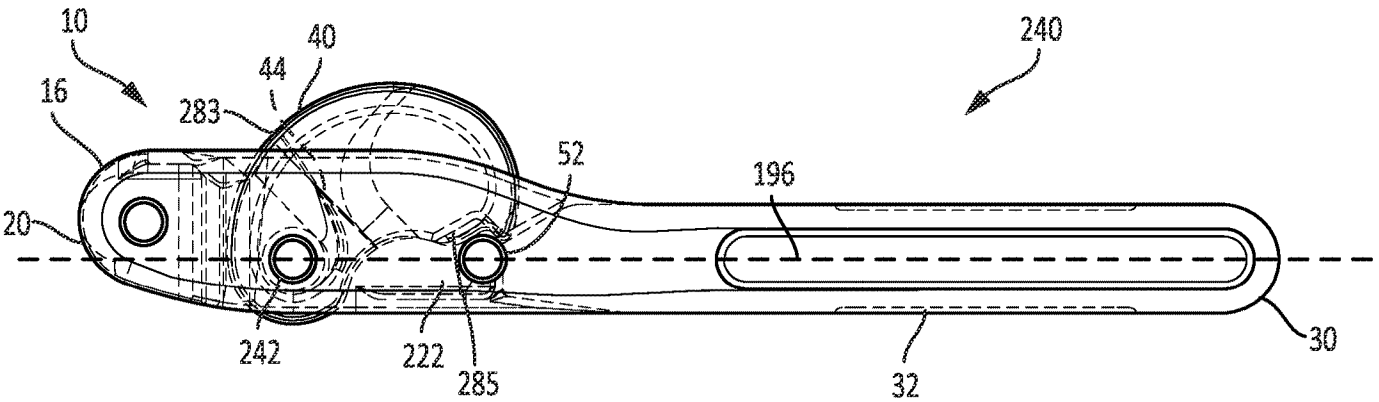
FIG. 2C
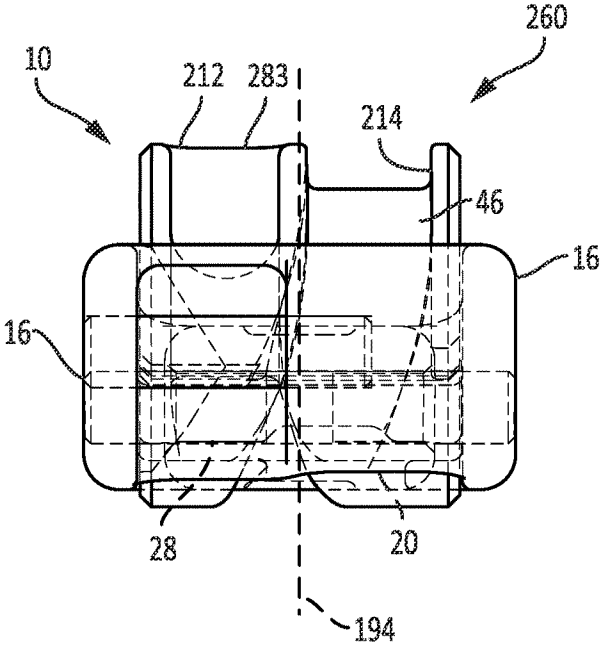
FIG. 2D
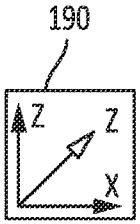

DESCENDING APPARATUS AND METHODS FOR USE OF SAME

CROSS REFERENCE TO RELATED APPLICATIONS

The present application claims priority to U.S. Provisional Application No. 62/509,284, entitled "Friction Device", and filed on May 22, 2017. The entire contents of the above-listed application are hereby incorporated by reference for all purposes.

FIELD

The present description relates generally to a friction device which may be used to descend a slope using a line.

BACKGROUND AND SUMMARY

Rappelling devices may be used to descend slopes, whether it be for recreational activities or in response to an emergency. For example, a user may descend from a burning building in response to a stairway being inaccessible. The user may anchor to one or more suitable devices located inside or outside of a building prior to descent. The user may exit the building and descend via an open window.

One example approach is shown by Herrli et al. in U.S. Pat. No. 8,925,680. Therein, a rappelling device is configured to auto-lock, pay-out, and descend based on an actuation of a lever and/or handle. A line wraps around an outer portion of a cam and passes through a body of the rappelling device in an S-configuration.

However, the inventors herein have recognized potential issues with such systems. As one example, a range in which a user may control friction applied to the line is limited. One or more of egressing through a window sill and/or moving laterally with the rappelling device may be difficult. For example, the rappelling device may hang-up (e.g., stop descent and/or payout of the line) as the user attempts to egress through the window and/or move laterally to avoid obstacles. This may result in an uncomfortable and inconsistent descent, which may lead to the user becoming stuck at the window and consume time before re-initiating descent, thereby exposing an anchor end of the system to increased loads and high temperatures. In another example, the line of Herrli enters the device on the un-constrained infeed side, passes through the handle once and is pinched by the cam during its second transect of the handle plane before turning around the cam feature and exiting towards the anchor. The arrangement of features presented by Herrli relies heavily on the cam pressing on the escape line to provide a large share of the overall friction, which may increase wear on the line and decrease its life expectancy. In yet another example, in the rappelling device taught by Herrli, the escape line passes through the handle several times, causing the escape line to interact with the handle, passing part of the dissipated energy into the handle in the form of heat. This may result in the handle overheating, thereby limiting how long the device may be used before the accumulated frictional heat inhibits operation of the rappelling device.

In one example, the issues described above may be addressed by a system comprising a body comprising a handle and a pocket, wherein a pivotable bollard is located in the pocket, the bollard comprising an outer surface wherein a defined path for a line wraps around more than half a circumference of the bollard, the defined path is coupled to a first end of a line-passing through-hole, a second end of the line-passing through-hole located adjacent to the defined path.

In another example, the issues described above may be addressed by a body comprising a handle and a pocket, wherein a pivotable bollard is located in the pocket, the bollard comprising a line-passing through-hole with a first opening coupled to a groove of the bollard, where the groove extends from the first opening, wraps around an entire circumference of the bollard, and passes adjacent to a second opening of the line-passing through-hole.

As an example, a body comprises a tether end and a handle end located opposite one another. The tether end comprises a tether configured to couple to a loop. For example, the tether may couple to a harness worn by a user. The pocket is proximal to the tether end. Thus, a line enters the body at a first surface and is inserted into the line-passing through-hole and wraps around the defined path arranged around at least a portion of an outer surface of the bollard. The line encounters a pinch pin prior to exiting the body at a second surface, opposite the first surface. Geometries of the bollard allow an amount of friction applied to the line from one or more of the bollard and the pinch pin to be adjusted based on an actuation of the handle.

In one example embodiment, a device in the present disclosure may create a pinching action at the point of infeed with a total angular deviation beyond the pinching point in excess of 360 degrees. Furthermore, the geometry at the exit of the device may provide a v-groove that further increases friction in a way that is variable with the location of the handle.

By providing a descent mechanism that achieves the majority of frictional resistance by angular deviation of the line around a bollard with a lesser amount of friction resulting from a pinching action on the line, the line may experience less wear, and have a longer life expectancy, than a line used with a rappelling device which exerts most of friction on a line via pressure from a cam feature, as taught by Herrli. Further, this enables the line to have a looser construction which in turn aids in packaging of the line.

Another benefit of the mechanism presented in this disclosure is the management of frictional heat dissipated in the descender. In the descender disclosed below, the majority of frictional heat enters the pivoting bollard, which is a separate part from the descender body, and therefore reduces the rate of frictional heat propagation from the bollard, through the body, to the handle. This reduces the rate of heat buildup in the handle compared to the teachings of Herrli, and allows longer descents without overheating the handle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 2A, 2B, 2C, and 2D show various cross-sections of the first embodiment of the device.

FIGS. 1-7D are shown approximately to scale.

DETAILED DESCRIPTION

Figure 1:
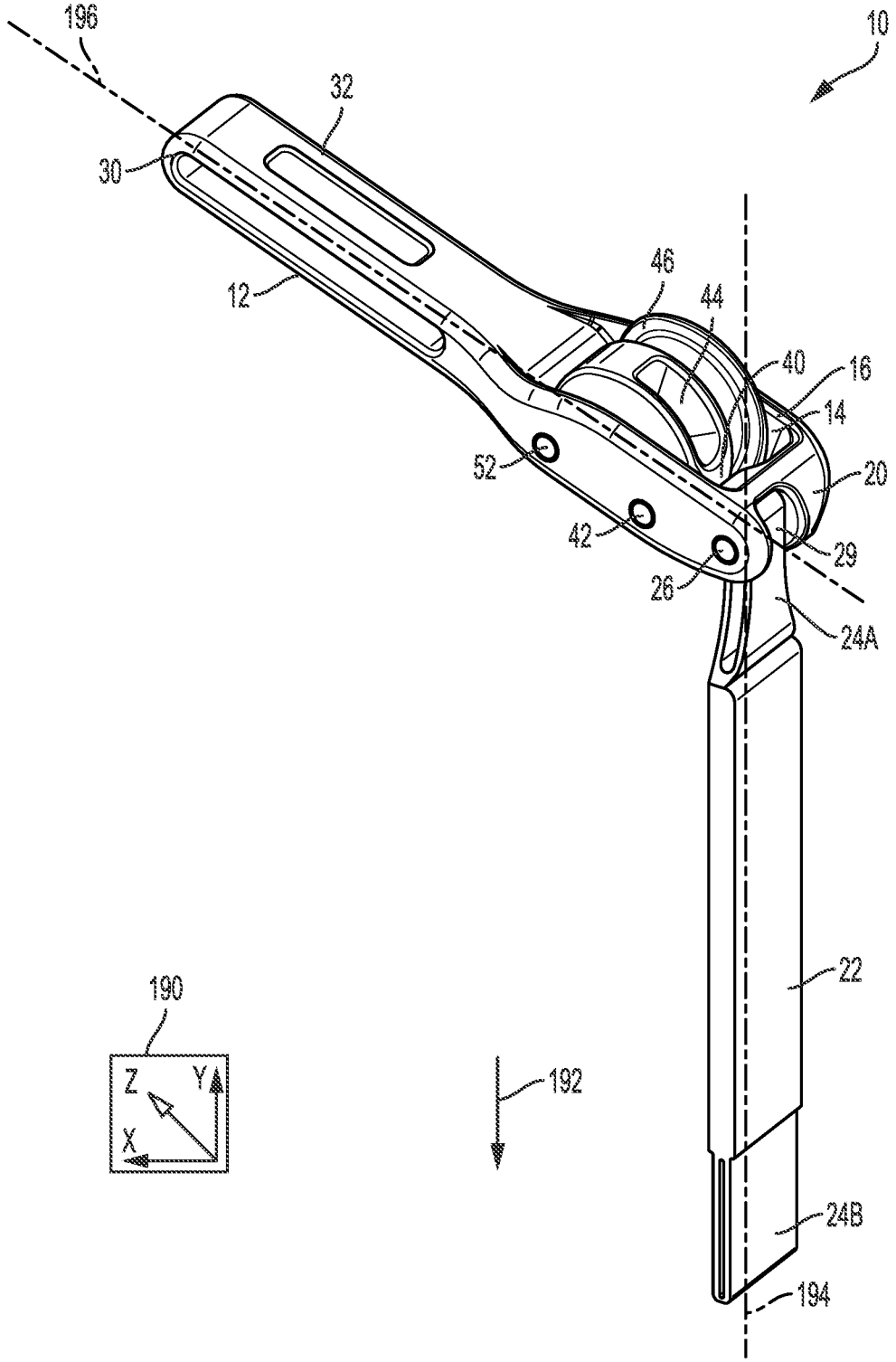
FIG. 1 shows a perspective view of a first embodiment of a device.

The following description relates to systems and methods for a device. The device comprises a handle for actuating one or more pivoting components configured to receive a line and/or web and/or rope, as shown in FIG. 1. In the example of FIG. 1, the device further comprises a tether configured to couple to a user. The device comprises one or more components configured to receive an anchor (e.g., a line), wherein the components are configured to apply friction to the anchor based on an actuation of the handle. Cross-section of the device are shown in the FIGS. 2A-2D to better illustrate the components located within the device.

In one example, the device is a rappelling device and is configured to provide one or more modes of operation. Additionally or alternatively, a bollard of the device is configured for lowering a load or progress capture. The bollard may be further configured to resist a force, such as moving wind and/or water.

Figure 3A:
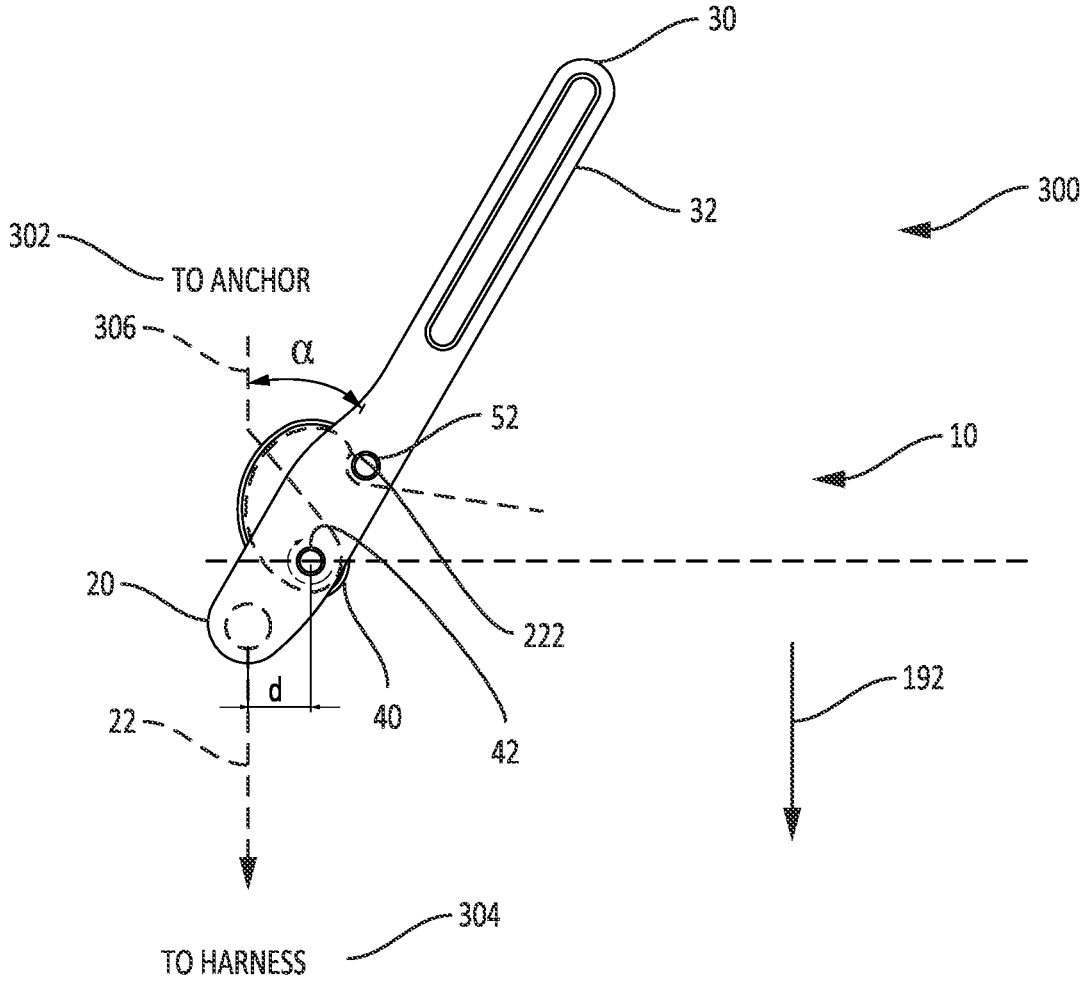
FIGS. 3A, 3B, and 3C show various positions of the device.
Figure 3B:
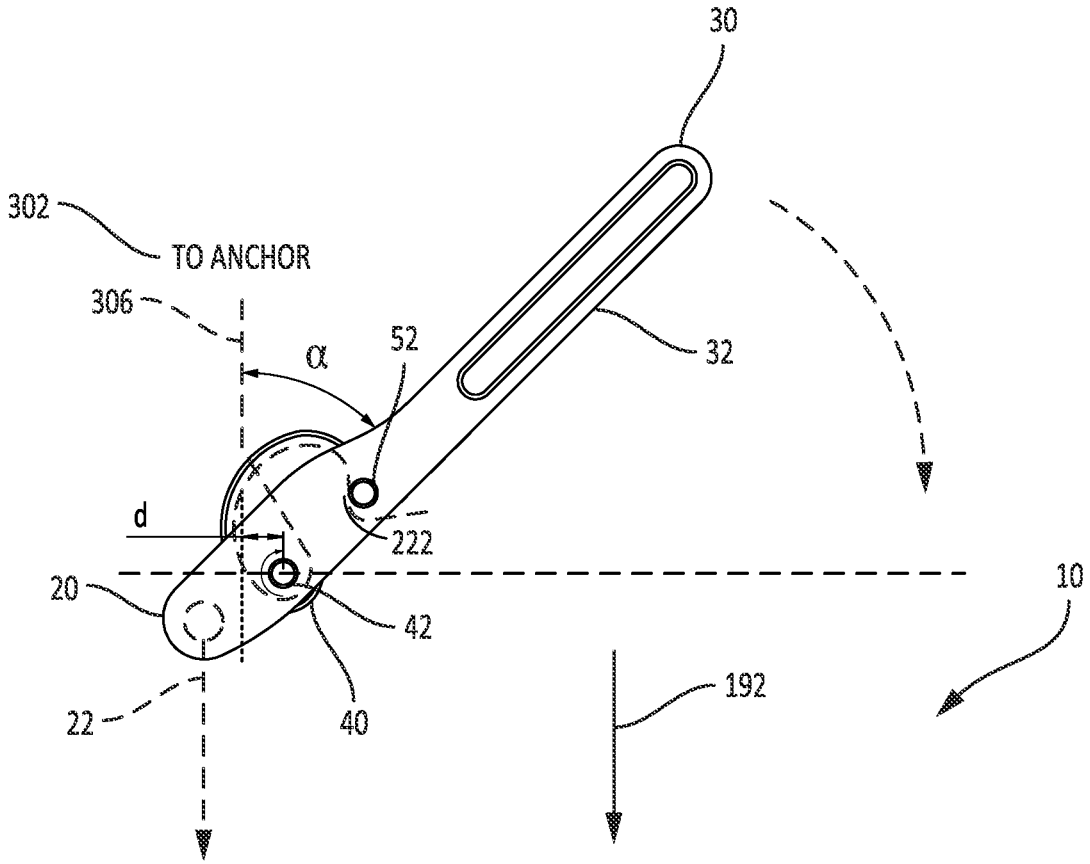
Figure 3C:
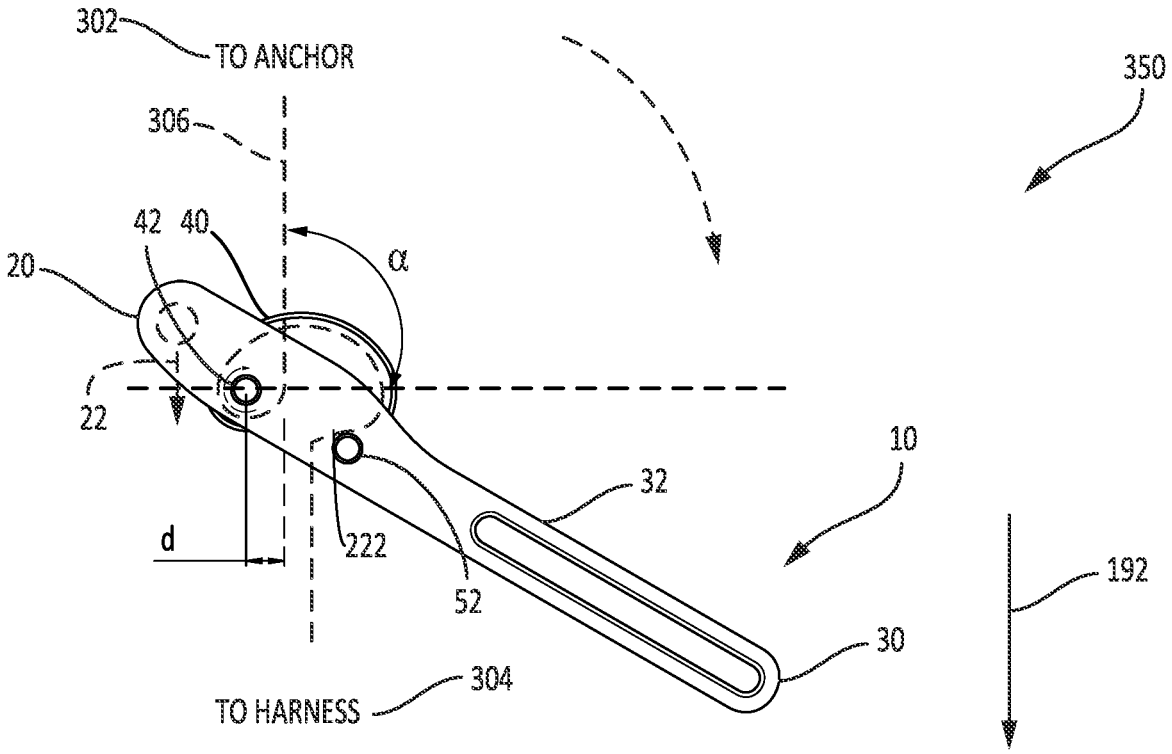
Figure 4A:
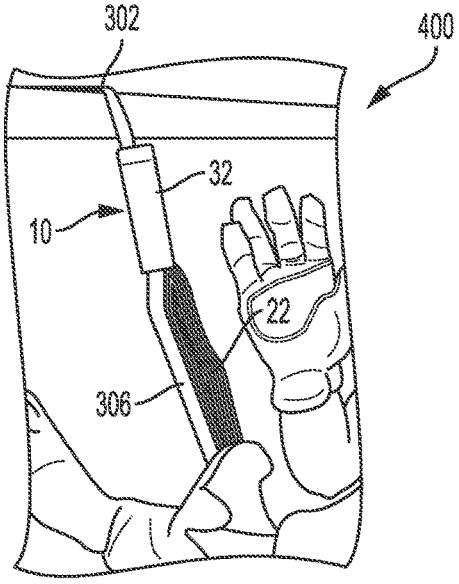
FIGS. 4A, 4B, and 4C show the device being actuated by a user to perform different functions.
Figure 4B:
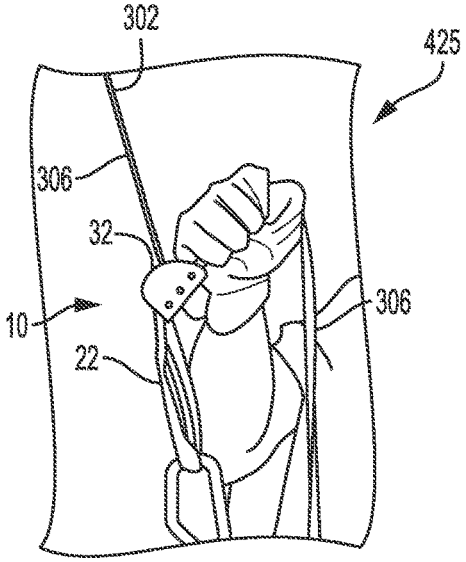
Figure 4C:
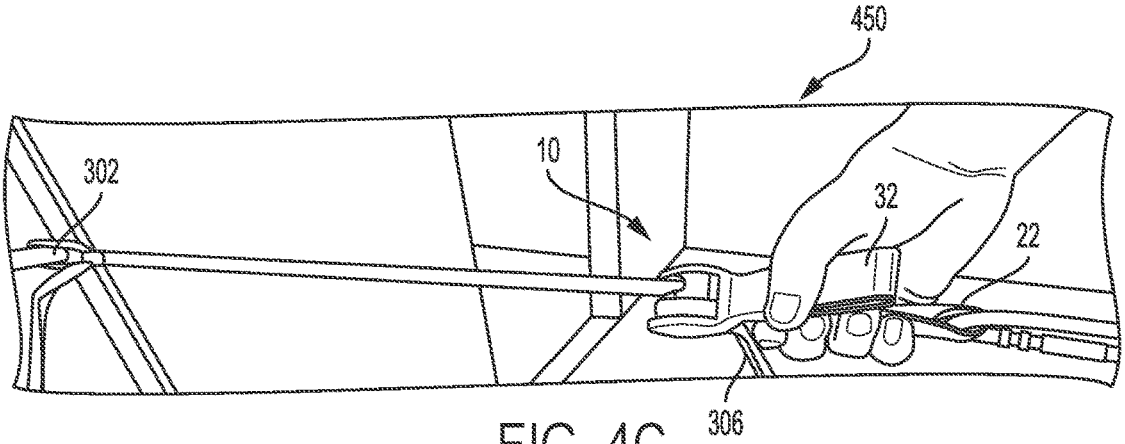

In the embodiments of FIGS. 3A, 3B, and 3C, the device is coupled to an anchor point via a line and/or web. The line and/or web may be referred to herein interchangeably as a line. The line enters the bollard of the device in an initial direction substantially parallel to a direction of the tether via a passage located interior to the bollard. The passage transects the bollard before leading to an outer surface. The line exits this passage and wraps around the outer surface of the bollard along a defined path, the defined path passing adjacent to the line entering the bollard before passing through an area of pinch and exiting the device through an alignment eye in the handle. In one example, the defined path may comprise a groove. In another example, the defined path may comprise one or more raised features extending outwards from an outer surface of a bollard. The location at which the line passes through the region of pinch, and exits the device, may also herein be referred to as the infeed point, as line may be fed into the device at this point while rappelling, in order to move downward from an anchor point, towards a lower point, such as the ground. In other words, while rappelling, the device may slide down along an anchored line, the line entering, or being fed into the device, at the infeed point. Likewise, the side of the device on which this occurs may be referred to herein as the infeed side of the device. Various degrees of actuation of the handle of the device along with modes of operation of the device are further shown in FIGS. 3A, 3B, and 3C. More detailed depictions of the handle being actuated in relation to the line and the tether are shown in FIGS. 4A, 4B, and 4C.

Figure 5A:
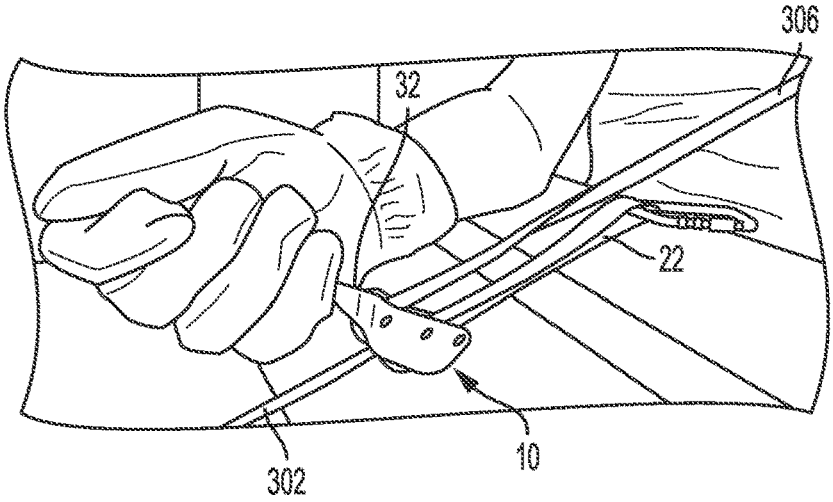
FIGS. 5A, 5B, and 5C show the device being actuated over a ledge.
Figure 5B:
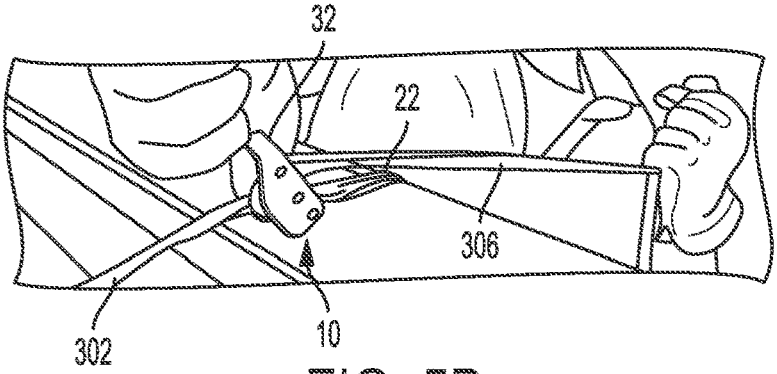
Figure 5C:
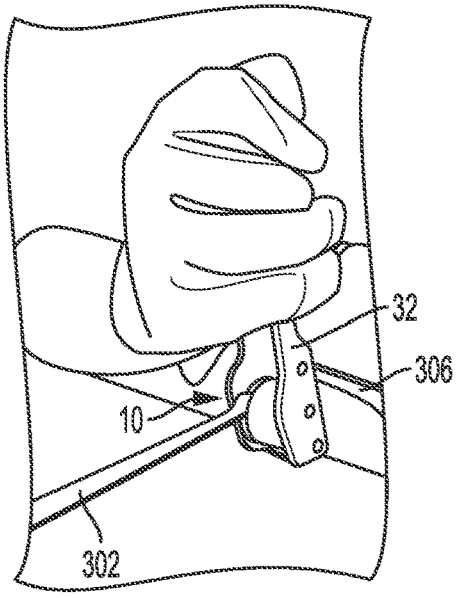

For rescuers and others trying to escape a building and/or descend a slope, it is desired to overcome obstacles. In some examples, the slope may be a wall of a building and obstacles may include window sills, balconies, and the like. Additionally, examples of the slope may include a side of a cliff, wherein the obstacles may include protruding rocks, ledges, and the like. The device is shown in FIGS. 5A, 5B, and 5C being actuated by a user exiting a building through a window, wherein the handle is varyingly actuated to controllably cross window sill.

Figure 6:
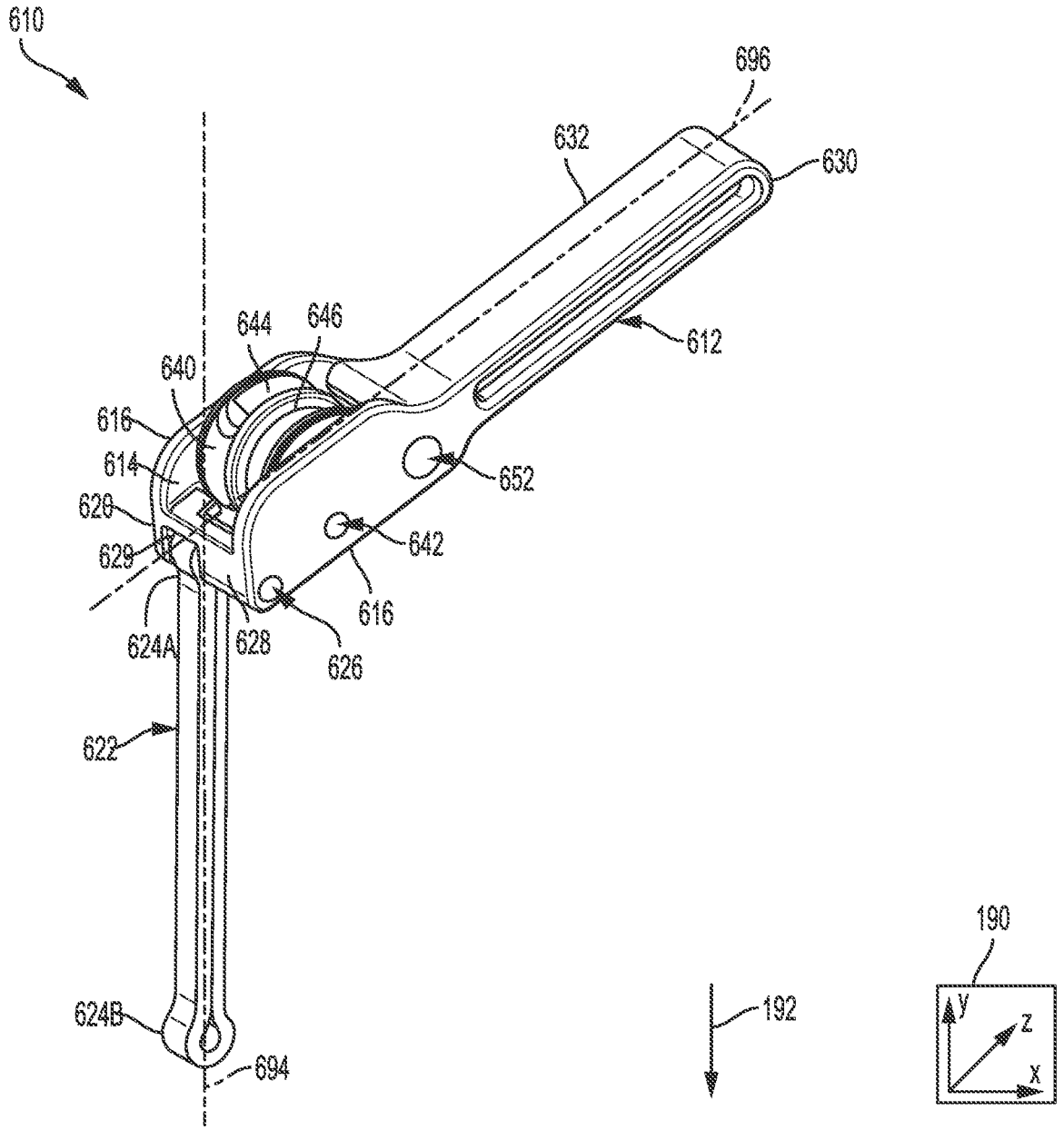
FIG. 6 shows a perspective view of a second embodiment of a device.

The device may comprise various embodiments while staying within the scope of the current disclosure. FIG. 6 shows an example of a second embodiment of the device, wherein one or more components may be related to one of more components of FIG. 1. FIGS. 7A, 7B, 7C, and 7D illustrate the components within the second embodiment of the device.

FIGS. 1-7D show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Turning now to FIG. 1, it shows a device 10. Herein, the device 10 is a descent device configured to assist a user to egress from an area of higher altitude to an area of lower altitude. In one example, the device 10 may be used to allow a user to escape from a building, wherein the device allows the user to anchor to one or more suitable device located inside or outside the building, exit through a window, and rappel to a ground outside the building.

An axis system 190 comprising three axes, namely an x-axis parallel to a horizontal direction, a y-axis parallel to a vertical direction, and a z-axis perpendicular to each of the horizontal and vertical directions is shown. Arrow 192 indicates a direction of gravity. Herein, arrow 192 is referred to as gravity 192. A first axis 194 is shown parallel to the direction of gravity and a second axis 196 is shown substantially oblique to gravity 192 and the first axis 194. As will be described herein, the second axis 196 may move relative to the position shown, wherein the second axis 196 may be actuated through a range of positions angled to the first axis 194, wherein the range includes angles parallel, oblique, and perpendicular to the first axis 194.

The device 10 and the components described herein may be comprised of one or more of aluminum, carbon fiber, magnesium, plastics, steel, iron, and a combination thereof. The device 10 may be a single, contiguous piece. In one example, the device 10 comprises a plurality of components, wherein a body is a single uninterrupted piece comprising a moveable component and a linking component coupled thereto.

The device 10 comprises a body 12 arranged parallel to the second axis 196. The body 12 extends from a tether end 20 to a handle end 30, wherein a height of the tether end 20 along the y-axis is less than a height of handle end 30. A pocket 14 is located proximally to the tether end 20, wherein the pocket 14 is open and/or uncovered along the top and bottom portions of the body 12. There may be an alignment feature, such as alignment eye 254 (not shown), located in the bottom portion of the pocket at the infeed point. The alignment eye may be located in a bottom portion of handle 32 near the location of line infeed, and may align the line being fed into the device 10 with defined path 46. The pocket 14 is surrounded by two substantially identical side walls 16. The side walls 16 are spaced away from one another along the z-axis, where a distance of the spacing is equal to a thickness of the pocket 14. Each of the side walls 16 are fixedly coupled to a tether end surface 28 and a handle 32 at respective extreme ends of the side walls. The side walls 16 are planar along the x- and y-axes. The side walls 16 may not comprise a 90° corner. As such, the side walls 16 may be rounded and smoothly transition toward the tether end surface 28 and the body 12, which may allow a user to more easily egress over an obstacle. For example, if the device 10 contacts a surface, the one or more rounded surfaces may soften contact and reduce a force between the surface and the device 10, such that the device 10 may move more easily across the surface than a device with 90° edges.

A cross-section of the side walls along the second axis 196 may be substantially D-shaped. As such, the body 12 is longer along the handle 32 than it is along the side surfaces 16. In one example, the handle 32 is between 50-75% of the total length of the body 12. Other cross-sectional shapes of the side walls 16 and the handle 32 may be realized without departing from the scope of the present disclosure.

A tether 22 hangs from the tether end 20 along the first axis 194. The tether 22 comprises a free end 24 configured to physically couple to an auxiliary device. In one example, the auxiliary device is a carabiner coupled to a loop of a harness, which may be worn by a user. The tether 22 may comprise of one or more of rope, rubber, braided cord, and/or other materials suitable for supporting large amounts of weight (e.g., greater than 300 lbs).

The body 12 comprises a tether pin 26 arranged along the tether end 20. The tether pin is rod-shaped, in one example. The tether pin 26 extends through cutouts located in the side walls 16 in a direction substantially parallel to the z-axis perpendicular to a plane of the side walls 16. The cutouts are located directly across from one another along the z-axis. The tether pin 26 is physically coupled to the sides of the cutout in the tether end 20. Welds, fusions, adhesives, and the like may physically couple the tether pin 26 to the side walls 16 or tether end 20. The tether pin is fixedly located in the device 10 and does not slide, rotate, and/or move.

The tether pin 26 is obscured from a viewer by the tether end surface 28 apart from a cutout 29, where the tether 22 is shown physically coupled to and wrapped around the tether pin 26 at a first loop 24A. As shown, the cutout 29 is biased toward a side wall of the side walls 16. However, it will be appreciated that the cutout 29 may be spaced equally between the side walls 16 without departing from the scope of the present disclosure. The first loop 24A permits the tether 22 to rotate about an axis of the tether pin 26 (e.g., the z-axis). The tether 22 further comprises a second loop 24B arranged along an extreme end of the tether 22 opposite the first loop 24A. The second loop 24B is substantially identical to the first loop 24A in size and shape. In one example, the second loop 24B is configured to couple to a carabiner. In this way, the tether 22 and tether pin 26 are strong enough to support a user's weight. Additionally or alternatively, the second loop 24B may be larger or smaller than the first loop 24A. In some embodiments, the tether 22 may be a single loop. This pinned attachment method of the tether allows the loops to be sewn before becoming attached to the handle.

A bollard 40 is mounted in the pocket 14 of the device 10 at a location biased toward the tether end 20. In one example, the bollard 40 is cylindrically shaped, with a height of the bollard 40 being parallel to the z-axis. As such, a cross-section of the bollard 40 taken along the x-axis is circular. In one example, a diameter of the bollard 40 is slightly larger than a height of the side wall 16 such that a portion of the bollard 40 protrudes out the pocket 14. In another example, a cross-section of bollard 40 taken along the x-axis may be kidney shaped.

The bollard 40 is pivotally arranged in the pocket 14 between each of the side walls 16, tether end surface 28, and handle 32. In one example, the bollard 40 is slightly spaced away from each of the side walls 16, tether end surface 28, and handle 32 such that a small gaps and/or spaces are located between the bollard 40 and the boundaries surrounding the pocket 14. This may allow the bollard 40 to pivot and/or partially rotate smoothly without frictional forces imparting from the body 12 of the device 10.

A bollard pin 42 is shown extending through a side wall of the side wall 16 nearest a viewer along the z-axis. The bollard pin 42 is physically coupled to each of the side walls 16 at each of its respective extreme ends. Welds, fasteners, adhesives, and the like may physically couple the bollard pin 42 to the side walls 16. The bollard pin 42 is rod-shaped, in one example. A passage is located within the bollard 40 for receiving the bollard pin 42. As such, the bollard pin 42 extends through an entire height of the bollard 40. In one example, the bollard 40 is coupled to the bollard pin 42 such that the bollard 40 may smoothly pivot about an axis of rotation of the bollard pin 42. The axis of rotation of the bollard pin 42 may herein also be referred to as the bollard pivot point, or the pivot point of the bollard. In this way, the bollard 40 may rotate and/or pivot about the z-axis. In an alternative embodiment, a similar pivoting support could be achieved by two small side-axles protruding from the bollard 40 and interfacing with the sidewalls 16 in a way that allows the side axles to rotate in the sidewalls 16. The side-axles may comprise cylindrical protrusions pivotally coupling bollard 40 with side walls 16 by insertion of the cylindrical protrusions into holes in side walls 16. Bollard 40 may rotate and/or pivot about the z-axis around an axis of rotation of the side-axles of bollard 40.

The bollard 40 comprises a line-passing through-hole 44 and a defined path 46. In one example, defined path 46 comprises a substantially u-shaped groove or indentation in the outer surface of bollard 40. In another example, defined path 46 comprises one or more raised features extending from bollard 40. The line-passing through-hole 44 and the defined path 46 function synergistically with one another. The line-passing through-hole 44 is configured to receive a line, string, web, line, and the like. The line-passing through-hole 44 directs the line to the defined path 46, which extends from an opening of the line-passing through-hole 44 directed toward a bottom of the device 10. The line follows this defined path 46 in an initial direction towards the tether end 20, passing adjacent to the initial entry point of the line passing through-hole 44 and continuing its wrap around the bollard 40 until it passes an area of pinch between the bollard and the handle adjacent a pinch pin 52 and finally exiting the handle through alignment eye 254 (not shown). The pinch pin 52 extends along the z-axis and is physically coupled at its extreme ends to the side wall 16. A junction located between the pinch pin 52 and the bollard 40 may be sized such that a friction applied to the line by the pinch pin 52 is adjusted based on a position of the handle 32.

For example, the first opening of the line-passing through-hole 44 admits a line which traverses therethrough, wherein the line smoothly wraps around the defined path 46 immediately after exiting the second opening, or end, of the line-passing through-hole 44. This smooth transition from the line-passing through-hole 44 to the defined path 46 allows the device 10 to finely tune an amount of friction applied to the line, as will be described in greater detail below.

The handle 32 extends from the pinch pin 52 to the handle end 30 along the second axis 196. The handle 32 is configured to move the body 12 in relation to the line entering the device 10. When a user applies a hand force to the handle 32, the bollard 40 pivots where an overturning moment on the bollard changes and an interaction between the line passing through the device 10 and a pinch pin 52 is adjusted. Additionally, frictional force applied by a bending of the line in the bollard 40 is adjusted as the handle 32 is actuated. Specifically, the user may apply the hand force in a downward direction away from an anchor point and toward the tether 22. Release of this hand force may result in the handle 32 actuating toward the anchor and away from the tether 22, as will be described below with respect to FIGS. 3A, 3B, and 3C.

In some embodiments, additionally or alternatively, there may be a feature integrated with the handle, bollard, or pinch-pin that acts as a hard stop to control the minimum gap between the pinch pin and the bollard. The size of this gap limits the maximum amount of pinch-induced drag on the line and thus the maximum holding force of the entire device. This feature can be sized such that the maximum holding force of the device is limited to a desired value, reducing the shock-induced force on the anchor point, and also improving the fidelity of the release.

In some embodiments, the device comprises a roughly kidney-shaped bollard, movably mounted on a pivot biased towards the bottom of the bollard near a tether end. The kidney-shaped bollard may comprise a first and second lobe, wherein the first and second lobes are contiguous and may comprise different radii of curvature. The bollard pivot point may be located in the first lobe located proximal to the tether end of the descender, and the second lobe may act in conjunction with a pinch pin to produce a pinching or squeezing force on a line passing through a pinch region or junction. There is a line-passing through-hole extending through an entire thickness of the bollard, positioned at an angle such that a line enters the bollard in a position biased towards an anchor attachment point when viewed in relation to a pivot-mount of the bollard. On the anchor-side of the line-passing through-hole, a relief may be cut to fine-tune the total amount of moment that the incoming line can effect on the bollard. As described below, this relief may take the shape of a v-groove, which may further increase adjustability of friction imparted upon a line passing around this corner and/or turn. The corner and/or turn may induce a friction onto the line due to a geometry of the line as it passes through the bollard. The exit of the line-passing through-hole connects with a spiral line-path (achieved via detent of borders) that wraps around the bollard towards the tether end, past the entry hole on the bollard and continues past 270 degrees of wrap around the bollard, in one example. The shape of the bollard in the area of the pinch zone may be further optimized to adjust the relationship between overturning moment on the bollard imparted by the escape line entering it via the line-passing through hole and the pinch force exerted on the escape line, effectively countering the overturning moment in achieving a balance of overturning moments about the bollard pin. This can be achieved by varying the direction of the normal force vector in the pinch area in relation to the bollard pivot point. The handle comprises the bollard and pivot mount as well as the attachment point for the device. It also presents a friction device against which the bollard can press the line as it exits the groove.

In this way, friction applied to the line may be adjusted based on actuation of the handle 32, which is described in greater detail with respect to FIGS. 3A, 3B, and 3C. The above described components are described in greater detail with respect to FIGS. 2A, 2B, 2C, and 2D.

Turning now to FIGS. 2A, 2B, 2C, and 2D, they show various perspective and cross-sectional views of the device 10 of FIG. 1. As such, components previously introduced may be similarly numbered in subsequent figures. Specifically, the cross-sections depict detailed illustrations of the pivoting bollard 40.

Figure 2A:
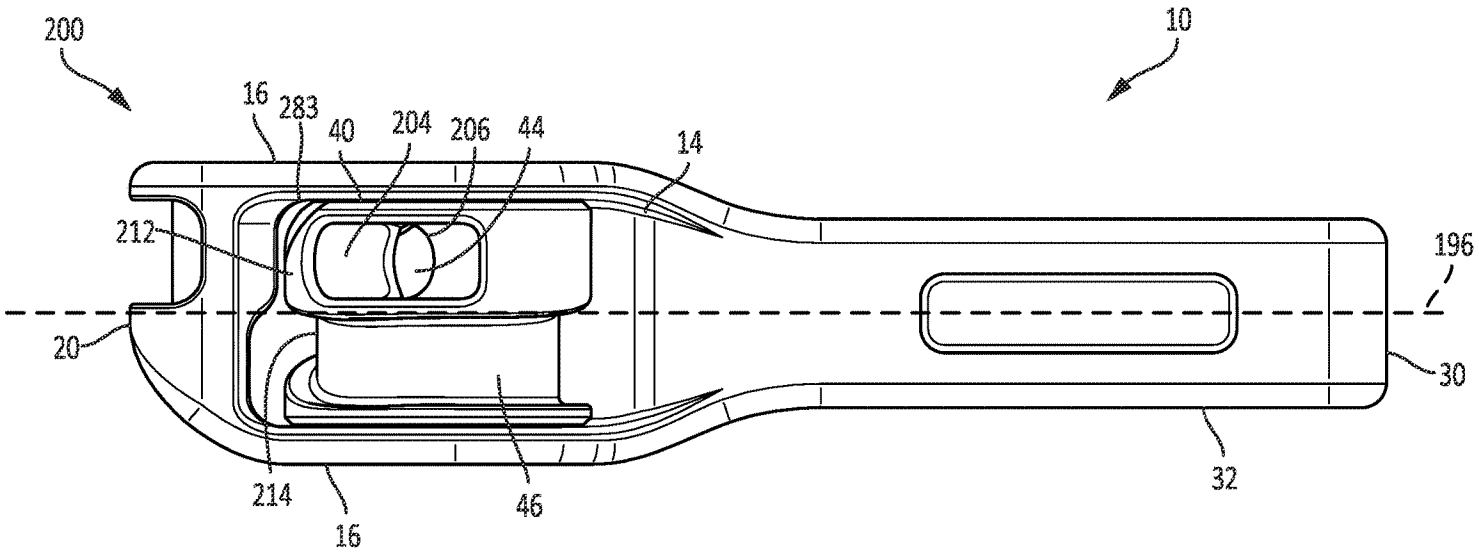

Turning now to FIG. 2A, it shows a top-down view 200 of the device 10 showing a detailed depiction of the bollard 40 arranged in the pocket 14. The line-passing through-hole 44 is depicted having a first open end 204 vertically higher than a second open end 206. Said another way, the first open end 204 is distal to a bottom opening of the pocket and the second open end 206 is adjacent the bottom opening. As shown, the line-passing through-hole 44 is offset from a center of the bollard 40. As shown, the bollard 40 is bisected along its center, with the line-passing through-hole 44 arranged on a first half 212 and a defined path 46 located along a portion of the second half 214.

The first open end 204 is configured to receive a portion of the line on an anchor side. In one example, the line is coupled to an anchor, where the anchor is an object which is stationary and may not move if a user hangs or pulls therefrom. An anchor side herein may refer to a top side and/or top opening of the pocket 14. The first open end 204 may comprise a rounded pocket that bevels an edge of the first open end 204 toward the handle end 30 of the device 10. In this way, the first open end 204 may be at least partially contoured and is not exactly circular. Specifically, the first open end 204 comprises a substantially orthogonal pocket, with an edge of the pocket relieved toward the handle end 30 of the device 10. In one example, the pocket is convex relative to the line-passing through-hole 44. The rounded pocket may be sized according to a desired magnitude of an overturning moment of the bollard 40 resulting from friction being applied to the device 10. For example, when the rounded pocket is larger, then the desired magnitude of the overturning moment decreases, which results in a lesser amount of friction being applied to the line. In some examples, the pocket is cut perpendicular to an axis of the line-passing through-hole 44, which is parallel to the y-axis. A depth of the cut adjusts a moment arm generated by a tensioned anchor line contacting the bollard 40 in relation to the bollard pin (e.g., bollard pin 42). The tension is administered to the device 10 by the line, coupled to the anchor, passing through the bollard 40 and a tether (e.g., tether 22) being coupled to a user hanging from the device 10.

The second open end 206 is configured to feed the line into the defined path 46, as described below in FIG. 2B. As shown, the first open end 204 and the second open end 206 are offset. That is to say, the line-passing through-hole 44 is diagonally arranged such that the first open end 204 is closer to the tether end 20 than the bollard pin 42 in the auto-lock orientation. As such, the line is forced to at least slightly bend upon entering the line-passing through-hole 44 as it passes through the bollard 40. This arrangement may ensure that a moment is generated through a movement range of the handle 32 between an auto-lock mode and a descent mode, as described below. When the handle 32 is rotated beyond the range of angles between the line and the handle 32 comprising the descent mode, the moment reverses direction, causing the bollard 40 to rotate towards the tether end 20 and relieving any pinch between the bollard 40 and the handle 32.

Figure 2B:
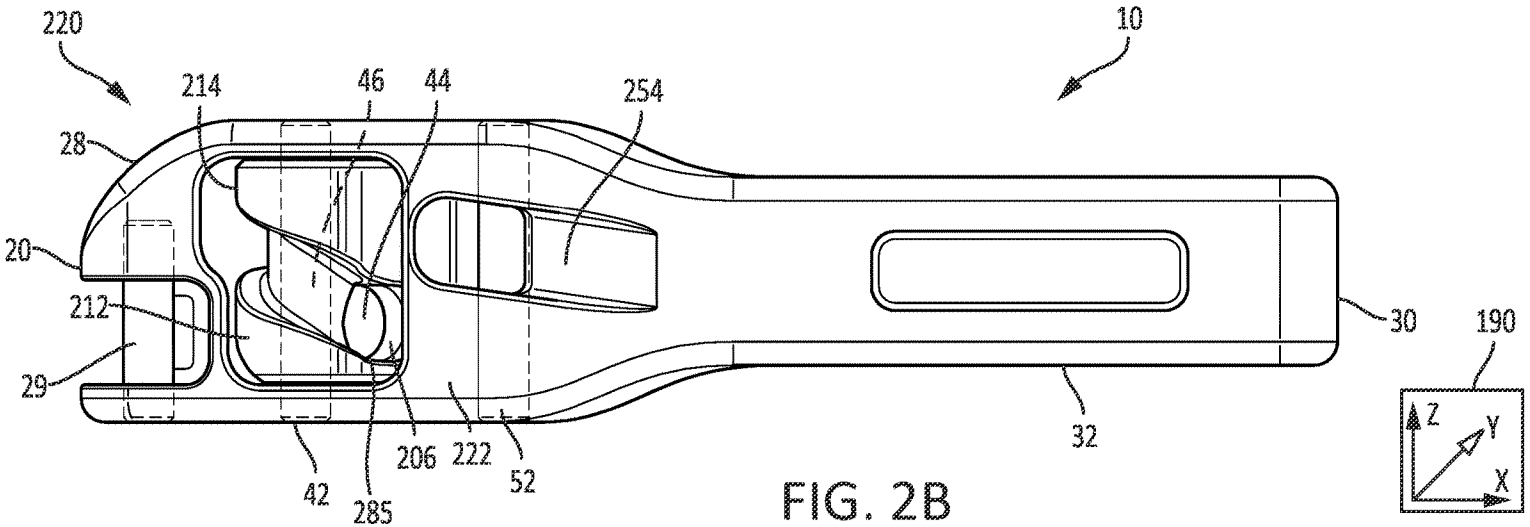

Turning now to FIG. 2B, it shows a bottom-up view 220 of the device 10. In the bottom-up view 220, the second open end 206 is depicted comprising defined path 46 leading from the second open end 206 on the first half 212 of the bollard 40 and around at least a portion of the second half 214 of the bollard 40. In one example, defined path 46 extends around an entire circumference of the second half 214 of the bollard 40. In another example, the defined path 46 extends at least around 50% of the circumference of the second half 214 of bollard 40. The second open end 206 may be beveled and/or chamfered to smooth a transition between the line-passing through-hole 44 and the defined path 46. In one example, the defined path 46 extends 270° around the bollard 40. It will be appreciated that the defined path 46 may traverse less than or more than 270° without departing from the scope of the present disclosure. The defined path 46 may be a spiral-shaped depression machined into an outer surface of the bollard 40. The defined path 46 is sized such that the walls or edges of the defined path 46 are high enough that the line may not fall, slide, and/or wiggle out of the defined path 46. As such, the defined path 46 may comprise raised edges such that the line does not misalign with the defined path 46 following assembly of the device 10 with the line. In one example, the defined path 46 is a V-shaped groove. However, it will be appreciated that the defined path 46 may be other suitable shapes, such as U-shaped, C-shaped, and the like without departing from the scope of the present disclosure. The defined path 46 initially directs the line toward the tether end 20, where the line then wraps around the defined path 46 toward the handle 30. In one example, a gap 222 located between the bollard 40 and the pinch pin 52 is sized such that the line may snuggly pass therethrough. The line exits the device 10 at an area adjacent the handle 32 between the pinch pin 52 and the bollard 40, through an alignment eye 254. Alignment eye 254 comprises a substantially rectangular cutout of a bottom portion of handle 32, which aligns with defined path 46. The edges and corners of alignment eye 254 are rounded, or sloped, such that a line may pass smoothly therethrough without catching, scrapping, or otherwise incurring damage from interaction with a sharp edge of the device 10. Alignment eye 254 is located in the bottom portion of the pocket at the infeed point, and thereby facilitates smooth infeed of line into defined path 46 as the device 10 slides downward along the line. The alignment eye may align the line with defined path 46, thus reducing a probability that the line may disengaged from defined path 46 during operation of the device 10.

Turning now to FIG. 2C, a cross-sectional view 240 of the bollard 40 is shown. In one example, the cross-sectional view 240 is parallel to the second axis 196 of FIG. 1. A pin receiving hole 242 is arranged adjacent to, but not intersecting, the line-passing through-hole 44. Specifically, the pin receiving hole 242 is oriented perpendicular to the line-passing through-hole, and biased towards a periphery of the bollard 40. In the embodiment shown in FIG. 2C, the pin receiving hole 242 is biased towards the periphery of the bollard 40 closer to the tether end 20. By having the pin receiving hole 242 biased towards a periphery of the bollard 40, rotation of the bollard 40 about the bollard pin 42 will be eccentric, and thereby may result in the gap 222 between the bollard 40 and the pinch pin 52 changing in size based on the position of the handle 32 relative to an anchored line. This may enable the angular position of the bollard 40 to adjust an amount of friction exerted on a line passing through gap 222. The pin receiving hole 242 is separate from (does not intersect with) the line-receiving through-hole 44 such that the bollard pin (e.g., bollard pin 42), which passes through the pin receiving hole 242, does not come into contact with the line passing through the line-passing through-hole 44. The bollard pin is fixedly coupled at both extreme ends of the bollard pin 42 such that the bollard pin 42 does not slide out of the pin receiving hole 242. The bollard 40 is configured to at least partially rotate and/or pivot about the bollard pin 42, as such the bollard pin 42 may also be referred to herein as the bollard pivot point. As the bollard 40 rotates, a size of the gap 222 between the pinch pin 52 and the bollard 40 may be adjusted. In one example, the gap 222 increases as the handle 32 is urged toward a tether (e.g., tether 22 of FIG. 1). Additionally, geometries of the bollard 40 impart varying frictional forces onto the line as the bollard 40 is rotated. This may include adjusting one or more bends and/or kinks in the line as it passes through and around the bollard 40, which may adjust a rate of descent and/or payout.

As shown, the line-passing through-hole extends through an entire transect of the bollard 40. This forces the line to enter the bollard 40 above the side walls 16 at a beginning 283 of the defined path 46, and exit the bollard 40 at a location adjacent to the pinch pin 52 at an end 285 of the defined path 46. The line thus wraps around greater than 50% of a circumference in the defined path 46 of the bollard 40 before exiting the device 10 in a location adjacent the pinch pin 52.

Turning now to FIG. 2D, a perspective view 260 is shown with the tether end 20 of the device 10 facing a viewer. The perspective view 260 looks down the second axis of the device 10 adjacent the tether end 20. The defined path 46 is shown extending from the first half 212 from a location at a bottom of the bollard 40 to the second half 214, where the defined path 46 wraps at least partially around the second half 214 of the bollard 40. Thus, in the example of FIG. 2D, the line enters the bollard 40 in a direction parallel to the first axis 194, passes through the line-passing through-hole of the bollard 40, extends toward the tether end 20 of the device 10, and continues to wrap around the defined path 46 toward the handle end, where the line passes through the gap located between the bollard 40 and the pinch pin 52. It will be appreciated that the line may enter the bollard 40 in a variety of directions, which may be dependent on one or more of a position of the user and an actuation of the handle (e.g., handle 32).

Thus, in one embodiment, an emergency descent device that may aid a user in egress over a sill and to the ground from an elevated position is shown. The device allows a large range of friction to be imparted onto the line. In one example, the device allows low-friction payout which may be useful for moving laterally from an anchor position to the beginning of descent. Once the device is loaded, it allows automatic friction build up to stop a descent without input from a user. When the device is actuated, a force-balance uses the incoming tension to generate friction and pinching of the line to provide a relative range of frictional forces allowing smooth release and restraint of the loaded line. Further, as the friction applied to the line by the descent device is spread over a section of line, with a greater portion of the friction being applied by the bend of the line as it wraps around the bollard, and a lesser portion of the friction being applied to the line by a pinching force applied to the line, a more even distribution of forces may act on the line, thereby reducing an amount of wear or damage done to the line and extending the life expectancy of the line. Additionally, as the bollard is connected to the handle through a limited number of contact points, such as the bollard pin, the rate of heat transfer between the bollard and the handle may be reduced compared to the device of Herrli, thereby reducing the likelihood of the handle overheating due to heat generated by friction between the line and the bollard.

Turning now to FIGS. 3A, 3B, and 3C, they show the device 10 coupled to one or more anchor points 302 and a harness 304. The device 10 is coupled to the anchor points 302 via a line 306. In one example, the line 306 is a rope. Additionally or alternatively, line 306 is a web. As shown, the line 306 enters the bollard 40 via the first open end 204 of the line-passing through-hole in a direction substantially parallel to a direction of the tether 22. The line 306 bends at a first moment of incidence adjacent the first open end 204. The line 306 passes through the line-passing through-hole (e.g., line-passing through-hole 44 of FIGS. 1, 2A, 2B, and 2C) linearly before wrapping around the spiral groove (e.g., spiral defined path 46 of FIG. 1). The line 306 exits the device at an area adjacent the handle 32 after passing through the gap 222 located between the bollard 40 and the pinch pin 52. The device 10 is coupled to the harness 304 via the tether 22.

It will be appreciated that FIGS. 3A, 3B, and 3C illustrate an example method of operating the rappelling device by rotating a body of the rappelling device about a bollard pin 42 of the rappelling device by actuation of the handle 32. In one example, a force applied to the handle increases through the figures such that the handle receives no force in FIG. 3A, as the device is in an equilibrium position, while receiving more force in FIG. 3B. Actuation of the handle may be measured by an angle $\alpha$ between the line 306 and the handle 32. The angle $\alpha$ may increase as handle 32 is actuated away from its equilibrium position towards the ground/away from the anchor point of the line.

The safety line 306 enters the device 10 via the line-passing through hole. As such, in the embodiment of FIG. 3A, the device is in equilibrium with the external forces acting upon it being the tension in the safety line 306 and the weight of the user via the tether 22. In one example, while the weight of the user acts on the tether end 20, and the tension of line 306 acts on device 10, and in the absence of a force exerted by a hand of a user on handle 32, the device 10 may return to the equilibrium position depicted in FIG. 3A. The position depicted in FIG. 3A may be referred to as an auto-lock mode, as the friction applied by device 10 to the line in this position may be sufficient to inhibit descent along the line. In the absence of any other external forces, the two tension vectors along the safety line 306 and tether 22 align. The force of the safety line enters the bollard 40 which is free to rotate about the bollard pin 42. Since the vector of the safety line 306 tension passes on the tether-end side of the bollard pin 42 by a distance d, there is an overturning moment generated by this force illustrated by the curved arrow at the bollard pin 42. This overturning moment is in a clockwise direction as shown in FIG. 3A and it is opposed by an equal and opposite overturning moment caused by the force of the bollard 40 pushing on the safety line 306 as it passes the pinch pin 52 on the handle-end of the bollard. The bollard 40 is thus in equilibrium with the net moment about the pinch pin being zero. Furthermore, in the embodiment of FIG. 3B, the handle has been rotated with respect to gravity 192 by a hand force pulling on the handle end. All internal components are again in equilibrium. Compared to FIG. 3A, the force vector of the tension in the safety line 306 still passes on the tether-end of the bollard pin 42 indicated by the arrow "d", however it passes more closely to the bollard pin 42, resulting in a reduction of the (clockwise) overturning moment imparted on the bollard 40 with respect to the bollard pin 42. Given that the bollard 40 remains in equilibrium with the sum of the moments about the bollard pin 42 being zero, it follows that in this orientation, the reaction force in the pinch zone has been reduced proportionally to the reduction in overturning moment due to the shift in the tension-line 306 vector with respect to the pinch pin 26. Additionally, the angular deviation of the safety line as it enters the line-passing through hole is reduced, further reducing friction. Lastly, in the embodiment of FIG. 3C, the handle has been rotated beyond the descent range into the payout orientation. In contrast to FIG. 3A and FIG. 3B, the projected vector of the tension in the safety line 306 now passes on the handle-end-side of the bollard pin by a distance "d". This causes a reversal of overturning moment on the bollard 40, anti-clockwise as shown in FIG. 3C. This rotation is limited by a physical stop between the bollard and the handle. The rotation of the bollard causes the gap between the bollard 40 and the pinch pin 52 to open up, eliminating or substantially reducing any friction between the pinch pin, the bollard and the line in this area. The angular deviation between the safety line 306 and the line passing through hole 44 is further reduced or eliminated, minimizing the total friction imparted on the safety line 306.

Turning now to FIG. 3A, an embodiment 300 of the device 10 is shown wherein the user is wearing a harness coupled to the device 10. In one example, the user is hanging in mid-air adjacent a vertical wall, thereby placing a tension on the tether end 20 of the device 10. However, it will be appreciated that the following description may also be applied to a user with both feet on the ground and where substantially little to no tension is applied to the tether end 20.

In the embodiment 300, the handle 32 is not actuated and the device 10 is in an auto-lock mode. The auto-lock mode may comprise a range of angles between handle 32 and line 306 between 0° and a first threshold angle, such that, so long as the handle 32 is not actuated to an angle greater than the threshold angle, the device 10 will remain in the auto-lock mode. In the auto-lock mode, a user is freely hanging in mid-air and is coupled to the device 10 via the tether 22. As shown, the handle 32 is not actuated and the angle $\alpha$ between the handle 32 and the safety line 306 is less than 90°. In other words, in the example depicted in FIG. 3A, the first threshold angle may be 90°, and the auto-lock mode may comprise angles between handle 32 and line 306 of 0°-90°. However, it will be appreciated that the first threshold angle may be greater than or less than 90°. In one example, the threshold first threshold angle may be 45° and the auto-lock mode may comprise angles between handle 32 and line 306 of 0°-45°. Angles less than the first threshold angle may be defined as threshold resting positions and/or threshold auto-lock positions. In one example, while device 10 is in the auto-lock mode the safety line 306 may bend approximately 90° as it enters the line-passing through-hole of the bollard 40, which may provide a first amount of friction, variable with handle 32 position. As the safety line 306 passes through the line-passing through-hole, the safety line 306 wraps around the bollard 40 providing a second amount of friction not variable by handle 32 position. The line is subsequently pinched at the gap 222 by the pinch pin 52. This imparts a third amount of friction. A combination of the first, second and third amounts of friction prevents the safety line 306 from passing through the device 10, which stops a user from descending. As such, the device 10 is in equilibrium.

Turning now to FIG. 3B, an embodiment 325 illustrates the device 10 in a descent mode wherein the handle is actuated away from the anchor 302 and toward the harness 304 and/or tether 22. In one example, if the handle were to be released, then it would return to the equilibrium auto-lock position shown in FIG. 3A. If the handle were further actuated, it would move to the position shown in FIG. 3C.

As illustrated, an amount of hand force is applied to the handle 32, which rotates the entire device 10. The descent mode may comprise a range of angles between handle 32 and line 306, wherein the range of angles comprises angles greater than the first threshold angle and less than a second threshold angle (the second threshold angle being greater than the first threshold angle). In one example, the descent mode may occur between angles between line 306 and handle 32 of 30°-45°, wherein friction applied to safety line 306 decreases as the angle $\alpha$ increases within this range. This may be defined as the descent mode.

The safety line 306 experiences a first friction as it enters the bollard 40 and bends as it passes through the bollard 40. Due to the change in handle angle, this first friction has been reduced. As such, the first friction experienced by the safety line 306 in the example of FIG. 3B is less than the first friction in the example of FIG. 3A. Additionally, a pinching at the gap 222 is less in the FIG. 3B than it is in the FIG. 3A. In this way, the device 10 may slide down the safety line 306, away from the anchor, and allow a user to descend. A rate of the descent is adjusted based on actuation of the handle 32 within the descent range. As such, the rate of descent may increase as the handle 32 is actuated in a downward direction, parallel to the direction of gravity, so the first and third friction components decrease.

Turning now to FIG. 3C, it shows an embodiment 350 of the device 10 wherein the handle 32 is being actuated to the harness 304 and/or tether 22. The position of device 10 depicted in FIG. 3C illustrates an example of a position corresponding to a pay-out mode of device 10. The pay-out mode may comprise a range of angles between handle 32 and line 306, wherein the range of angles is between the second threshold angle and a third threshold angle (the third threshold angle being greater than the second threshold angle). When the handle 32 is within the range of angles corresponding to the pay-out mode the bollard 40 is rotated and the friction applied to line 306 by device 10 is reduced significantly compared to the friction of the descent mode. In one example, the pay-out mode may be accessed only when substantially no weight is applied to the tether end 20 of the device 10, ensuring that the pay-out mode may be accessed only when a user has their weight supported by means other than line 306, such as when both feet of the user are on a solid object. In one example, the pay-out mode may be used when the user walks toward a window sill or similar opening to egress. The angle $\alpha$ is larger than the other angle $\alpha$'s illustrated in FIGS. 3A and 3B. Additionally, the safety line 306 passes through the line-passing through-hole substantially linearly, with no bends or kinks located therein. As such, a first friction is substantially eliminated. Furthermore, the third friction component between the safety line 306 and the pinch pin 52 does not occur, because the vector of the tension in the line causes the bollard 40 to rotate away from the pinch pin creating an open passageway. In this way, the device 10 may slide across the safety line 306, further away from the anchor 302, with relatively little opposing force.

In some embodiments, the device 10 may further include a panic mode, wherein the device 10 increases frictional forces applied to the line 306 when the angle $\alpha$ approaches a fourth threshold angle (where the fourth threshold angle is greater than the third threshold angle). In such an example, a user's feet are off the ground and the handle 32 is actuated to a position that would otherwise correspond to a pay-out mode position, resulting in a free fall. However, due to an orthogonality of the first open end of the line-passing through hole, the first friction begins to increase and the rate of descent decreases and/or stops. In such an example, the second open end of the line-passing through hole (e.g., second open end 206 of line-passing through-hole 44 of FIG. 2A) may comprise an orthogonal pocket similar to the orthogonal pocket of the first open end (e.g., first open end 204 of FIG. 2A). As such, an additionally area of pinch may occur adjacent a tether side of the bollard 40 when the handle 32 is actuated beyond the threshold descent position and a user is hanging from the device 10.

Turning now to FIGS. 4A, 4B, and 4C, they show the device 10 in the auto-lock mode, the descent mode, and the pay-out mode, respectively. In the examples of FIGS. 4A and 4B, the user is hanging in mid-air and their entire body weight is tensioned to the device 10. In the example of FIG. 4C, the user is resting their feet on the ground and is not hanging via the device 10, but is coupled to the device 10 nonetheless.

Turning now to FIG. 4A, the device 10 is not being actuated and the handle 32 extends toward the anchor point 302. A user is hanging via the device 10 and is coupled to the device via the tether 22. The line 306 extends from the anchor point 302, through the device, and exits the device 10 at an area adjacent the tether. In this way, the line 306 is vertically above the tether 22 when the device 10 is coupled to the user. The handle 32 is in the threshold auto-lock position.

In the auto-lock mode 400, a weight is applied to the tether end of the line and the device is allowed to reach equilibrium without any activation force on the body other than the weight and the safety-line, connected to an anchor. It is noteworthy that the arrangement of the tether attachment location and the exit of the line from the device place the overall body into a position that extends away from the tensioned line with a bias of the handle-end toward the anchor point of the line. In this orientation, the line passes into the line-passing through hole. This initial bend in the line is at its most extreme in this handle location. The arrangement of the force acting on this contact point in relation to the bollard axle location causes a turning moment on the bollard that forces it to pivot against the body of the device towards the pinch pin. The total friction caused by the initial bend of the line as it enters the line-passing through hole, exits the line-passing through hole, wraps around the bollard and becomes pinched between the bollard and the body of the device exceeds the total force exerted on the tether end of the device, forcing the line to remain stationary and preventing the user from descending down the line.

Turning now to FIG. 4B, where the device 10 is in the descent mode 425. The handle 32 is pulled toward the tether 22, and the device 10 slides down the line 306. As described above, the descent mode 425 comprises a range of positions, wherein a position of the handle 32 adjusts the friction applied to the line. For example, if the handle is closer to the tether 22, then the friction decreases. Furthermore, if the handle is further from the tether 22, then the friction increases. Additionally or alternatively, due to the proximity of the location where the line exits the device 10 to the tether 22, the user may easily grab the line 306 and the handle 32 together (as shown) and manually apply additionally friction. As such, if the user squeezes the line 306 and handle 32 harder, then the manual friction applied increases. This allows the user to actuate the handle and control the tail of the safety line with a single hand.

In the descent mode 425, a user activates the device by pulling on the handle-end of the device body and rotating the device away from the friction vector of the line. As the body of the device rotates, several factors change to gradually reduce the overall amount of friction provided by the device. The incoming angle of the safety-line into the device changes, resulting in a reduction of the total angle of bend the safety-line experiences as it becomes aligned with the line-passing through hole. This reduces the amount of friction generated by this bend in-line with the bollard equation.

The changing angle of the incoming safety-line with respect to the bollard pivot point changes, reducing the effective moment arm of the contact point between the safety-line and the bollard with respect to the bollard axle. Since the overall tension of the line can be considered constant, this action reduces the total moment on the bollard. Since this overturning moment is reacted by a resulting pinch force between the pinch pin and the bollard, a reduction in overturning moment on the bollard by the safety-line results in a proportional reduction in the amount of pressure exerted on the line as it passes between the bollard and the pinch pin, reducing the friction in this area.

The combined reduction of total angular deviation through and around the bollard as well as the reduced amount of pressure on the infeed section combine to modulate the total amount of friction provided by the device as the handle-end is rotated through the descent range of the device. Beyond the full descent-actuation, the device enters the payout mode, described below.

Turning now to FIG. 4C, in the payout mode 450, the desired function is for the device to provide minimal friction to the safety line as it passes through the device. To engage this mode of operation, the user points the tether-end of the handle roughly towards the anchor point of the safety line. In this orientation, tension in the safety line as it enters the bollard causes the bollard to pivot towards the tether-end of the body, thus lifting the bollard away from the pinch pin and reducing pinch-induced friction in this area. The lowest overall friction is achieved when the bollard has pivoted fully away from the pinch pin and is constrained by a stop that is built into the body, and the body is oriented such that the major axis of the line-passing through-hole is collinear with the tensioned safety line. In this case, no angularity exists between this through hole and the tensioned line, so no additional friction is gained. The largest source of friction in this orientation is from the un-tensioned safety-line passing around the bollard and into the line-passing through-hole.

Turning now to FIGS. 5A, 5B, and 5C, they show the device 10 overcoming an obstacle encountered by a user when in the descent mode 425. Specifically, the FIGS. 5A-5C show a progression of the device 10 over the obstacle. As such, the events illustrated in FIG. 5B occur subsequent the events illustrated in FIG. 5A. Likewise, the events illustrated in FIG. 5C occur following the events illustrated in FIG. 5B.

Turning now to FIG. 6, it shows a device 610. Herein, the device 610 is a second embodiment of a descent device configured to assist a user to egress from an area of higher altitude to an area of lower altitude. One or more of the components or features of device 610 may correspond to features or components of the first embodiment device 10. In one example, the device 610 may be used to allow a user to escape from a building, wherein the device allows the user to anchor to one or more suitable device located inside or outside the building, exit through a window, and rappel to a ground outside the building.

An axis system 190 comprising three axes, namely an x-axis parallel to a horizontal direction, a y-axis parallel to a vertical direction, and a z-axis perpendicular to each of the horizontal and vertical directions is shown. Arrow 192 indicates a direction of gravity. Herein, arrow 192 is referred to as gravity 192. A first axis 694 is shown parallel to the direction of gravity and a second axis 696 is shown substantially oblique to gravity 192 and the first axis 694. As will be described herein, the second axis 696 may move relative to the position shown, wherein the second axis 696 may be actuated through a range of positions angled to the first axis 694, wherein the range includes angles parallel, oblique, and perpendicular to the first axis 694.

The device 610 and the components described herein may be comprised of one or more of aluminum, carbon fiber, magnesium, plastics, steel, iron, and a combination thereof. The device 610 may be a single, contiguous piece. In one example, the device 610 comprises a plurality of components, wherein a body is a single uninterrupted piece comprising a moveable component and a linking component coupled thereto.

The device 610 comprises a body 612 arranged parallel to the second axis 696. The body 612 extends from a tether end 620 to a handle end 630, wherein a height of the tether end 620 along the y-axis is less than a height of handle end 630. A pocket 614 is located proximally to the tether end 620, wherein the pocket 614 is open and/or uncovered along the top and bottom portions of the body 612. The pocket 614 is surrounded by two substantially identical side walls 616. The side walls 616 are spaced away from one another along the z-axis, where a distance of the spacing is equal to a thickness of the pocket 614. Each of the side walls 616 are fixedly coupled to a tether end surface 628 and a handle 632 at respective extreme ends of the side walls. The side walls 616 are planar along the x- and y-axes. The side walls 616 may not comprise a 90° corner. As such, the side walls 616 may be rounded and smoothly transition toward the tether end surface 628 and the body 632, which may allow a user to more easily egress over an obstacle. For example, if the device 610 contacts a surface, the one or more rounded surfaces may soften contact and reduce a force between the surface and the device 610, such that the device 610 may move more easily across the surface than a device with 90° edges.

A cross-section of the side walls along the second axis 696 may be substantially D-shaped. As such, the body 612 is longer along the handle 632 than it is along the side surfaces 616. In one example, the handle 632 is between 50-75% of the total length of the body 612. Other cross-sectional shapes of the side walls 616 and the handle 632 may be realized without departing from the scope of the present disclosure.

A tether 622 hangs from the tether end 620 along the first axis 694. The tether 622 comprises a free end 624 configured to physically couple to an auxiliary device. In one example, the auxiliary device is a carabiner coupled to a loop of a harness, which may be worn by a user. The tether 622 may comprise of one or more of rope, rubber, braided cord, and/or other materials suitable for supporting large amounts of weight (e.g., greater than 300 lbs).

The body 612 comprises a tether pin 626 arranged along the tether end 620. The tether pin is rod-shaped, in one example. The tether pin 626 extends through cutouts located in the side walls 616 in a direction substantially parallel to the z-axis perpendicular to a plane of the side walls 616. The cutouts are located directly across from one another along the z-axis. The tether pin 626 is physically coupled to the sides of the cutout in the tether end 620. Welds, fusions, adhesives, and the like may physically couple the tether pin 626 to the side walls 616 or tether end 620. The tether pin is fixedly located in the device 610 and does not slide, rotate, and/or move.

The tether pin 626 is obscured from a viewer by the tether end surface 628 apart from a cutout 629, where the tether 622 is shown physically coupled to and wrapped around the tether pin 626 at a first loop 624A. As shown, the cutout 629 is biased toward a side wall of the side walls 616. However, it will be appreciated that the cutout 629 may be spaced equally between the side walls 616 without departing from the scope of the present disclosure. The first loop 624A permits the tether 622 to rotate about an axis of the tether pin 626 (e.g., the z-axis). The tether 622 further comprises a second loop 624B arranged along an extreme end of the tether 622 opposite the first loop 624A. The second loop 624B is substantially identical to the first loop 624A in size and shape. In one example, the second loop 624B is configured to couple to a carabiner. In this way, the tether 622 and tether pin 626 are strong enough to support a user's weight. Additionally or alternatively, the second loop 624B may be larger or smaller than the first loop 624A. In some embodiments, the tether 622 may be a single loop. This pinned attachment method of the tether allows the loops to be sewn before becoming attached to the handle.

A bollard 640 is mounted in the pocket 614 of the device 610 at a location biased toward the tether end 620. In one example, the bollard 640 is cylindrically shaped, with a height of the bollard 640 being parallel to the z-axis. As such, a cross-section of the bollard 640 taken along the x-axis is circular. In one example, a diameter of the bollard 640 is slightly larger than a height of the side wall 616 such that a portion of the bollard 640 protrudes out of the pocket 614.

The bollard 640 is pivotally arranged in the pocket 614 between each of the side walls 616, tether end surface 628, and handle 632. In one example, the bollard 640 is slightly spaced away from each of the side walls 616, tether end surface 628, and handle 632 such that a small gaps and/or spaces are located between the bollard 640 and the boundaries surrounding the pocket 614. This may allow the bollard 640 to pivot and/or partially rotate smoothly without frictional forces imparting from the body 612 of the device 610.

A bollard pin 642 is shown extending through a side wall of the side wall 616 nearest a viewer along the z-axis. The bollard pin 642 is physically coupled to each of the side walls 616 at each of its respective extreme ends. Welds, fusions, adhesives, and the like may physically couple the bollard pin 642 to the side walls 616. The bollard pin 642 is rod-shaped, in one example. A passage is located within the bollard 640 for receiving the bollard pin 642. As such, the bollard pin 642 extends through an entire height of the bollard 640. In one example, the bollard 640 is coupled to the bollard pin 642 such that the bollard 640 may smoothly pivot about an axis of rotation of the bollard pin 642. The axis of rotation of the bollard pin 642 may herein also be referred to as the bollard pivot point, or the pivot point of the bollard. In this way, the bollard 640 may rotate and/or pivot about the z-axis. In an alternative embodiment, a similar pivoting support could be achieved by two small side-axles protruding from the bollard 640 and interfacing with the sidewalls 616 in a way that allows the side axles to rotate in the sidewalls 616. The side-axles may comprise cylindrical protrusions pivotally coupling bollard 640 with side walls 616 by insertion of the cylindrical protrusions into holes in side walls 616. Bollard 640 may rotate and/or pivot about the z-axis around an axis of rotation of the side-axles of bollard 640.

The bollard 640 comprises a line-passing through-hole 644 and a defined path 646. The line-passing through-hole 644 and the defined path 646 function synergistically with one another. The line-passing through-hole 644 is configured to receive a line, string, web, line, and the like. The line-passing through-hole 644 directs the line to the defined path 646, which extends from an opening of the line-passing through-hole 644 directed toward a bottom of the device 610. The line follows this defined path 646 in an initial direction towards the tether end 620, passing adjacent to the initial entry point of the line passing through-hole 644 and continuing its wrap around the bollard 640 until it passes an area of pinch between the bollard and the handle adjacent a pinch pin 652 before exiting the bottom of the device 610. The pinch pin 652 extends along the z-axis and is physically coupled at its extreme ends to the side wall 616. A junction located between the pinch pin 652 and the bollard 640 may be sized such that a friction applied to the line by the pinch pin 652 is adjusted based on a position of the handle 632.

For example, the first opening of the line-passing through-hole 644 admits a line which traverses therethrough, wherein the line smoothly wraps around the defined path 646 immediately after exiting the second opening, or end, of the line-passing through-hole 644. This smooth transition from the line-passing through-hole 644 to the defined path 646 allows the device 610 to finely tune an amount of friction applied to the line, as will be described in greater detail below.

The handle 632 extends from the pinch pin 652 to the handle end 630 along the second axis 696. The handle 632 is configured to move the body 612 in relation to the line entering the device 610. When a user applies a hand force to the handle 632, the bollard 640 pivots where an overturning moment on the bollard changes and an interaction between the line passing through the device 610 and a pinch pin 652 is adjusted. Additionally, frictional force applied by a bending of the line in the bollard 640 is adjusted as the handle 632 is actuated. Specifically, the user may apply the hand force in a downward direction away from an anchor point and toward the tether 622. Release of this hand force may result in the handle 632 actuating toward the anchor and away from the tether 622.

In some embodiments, additionally or alternatively, there may be a feature integrated with the handle, bollard, or pinch-pin that acts as a hard stop to control the minimum gap between the pinch pin and the bollard. The size of this gap limits the maximum amount of pinch-induced drag on the line and thus the maximum holding force of the entire device. This feature can be sized such that the maximum holding force of the device is limited to a desired value, reducing the shock-induced force on the anchor point, and also improving the fidelity of the release.

In some embodiments, the device comprises a cylindrical bollard, movably mounted on a pivot biased towards the bottom of the bollard near a tether end. There is a line-passing through-hole extending through an entire width of the bollard, positioned at an angle such that a line enters the bollard in a position biased towards an anchor attachment point when viewed in relation to a pivot-mount of the bollard. On the anchor-side of the line-passing through-hole, a relief may be cut to fine-tune the total amount of moment that the incoming line can effect on the bollard. As described below, this relief may take the shape of a v-groove, which may further increase adjustability of friction imparted upon a line passing around this corner and/or turn. The corner and/or turn may induce a friction onto the line due to a geometry of the line as it passes through the bollard. The exit of the line-passing through-hole connects with a spiral line-path (achieved via detent of borders) that wraps around the bollard towards the tether end, past the entry hole on the bollard and continues past 270 degrees of wrap around the bollard, in one example. The shape of the bollard in the area of the pinch zone may be further optimized to adjust the relationship between overturning moment on the bollard imparted by the escape line entering it via the line-passing through hole and the pinch force exerted on the escape line, effectively countering the overturning moment in achieving a balance of overturning moments about the bollard pin. This can be achieved by varying the direction of the normal force vector in the pinch area in relation to the bollard pivot point. The handle comprises the bollard and pivot mount as well as the attachment point for the device. It also presents a friction device against which the bollard can press the line as it exits the defined path.

In this way, friction applied to the line may be adjusted based on actuation of the handle 632. The above components are described in greater detail with respect to FIGS. 7A, 7B, 7C, and 7D.

Turning now to FIGS. 7A, 7B, 7C, and 7D, they show various perspective and cross-sectional views of the device 610 of FIG. 6. As such, components previously introduced may be similarly numbered in subsequent figures. Specifically, the cross-sections depict detailed illustrations of the pivoting bollard 640.

Figure 7A:
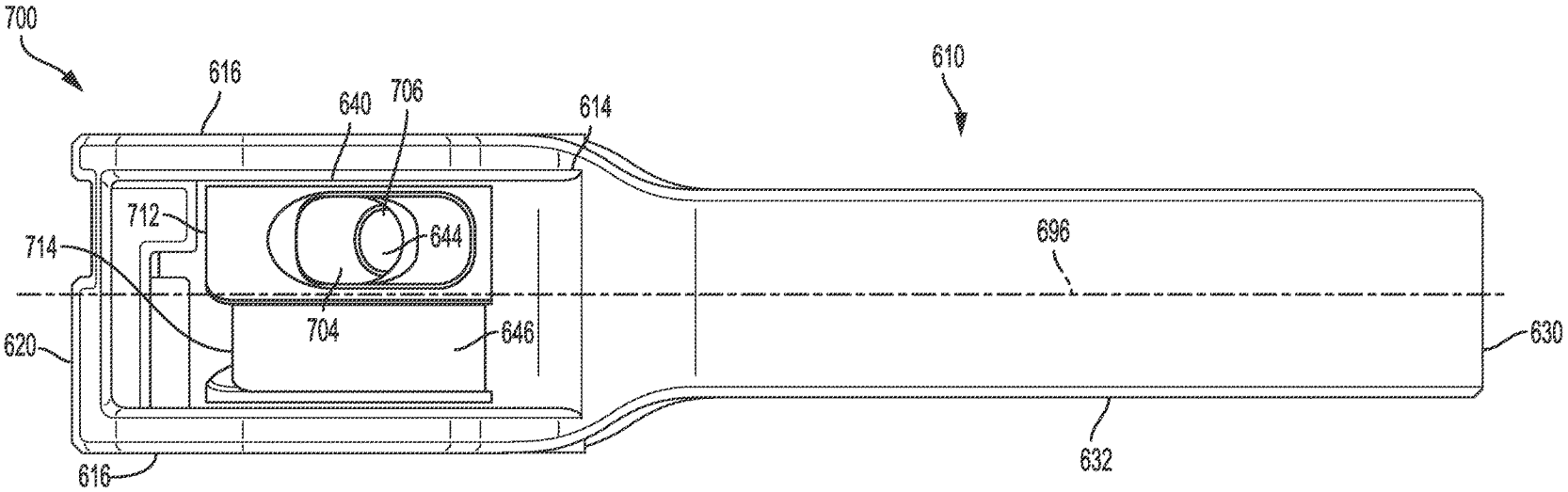
FIGS. 7A, 7B, 7C, and 7D show various cross-sections of the second embodiment of the device.

Turning now to FIG. 7A, it shows a top-down view 700 of the device 610 showing a detailed depiction of the bollard 640 arranged in the pocket 614. The line-passing through-hole 644 is depicted having a first open end 704 vertically higher than a second open end 706. Said another way, the first open end 704 is distal to a bottom opening of the pocket and the second open end 706 is adjacent the bottom opening. As shown, the line-passing through-hole 644 is offset from a center of the bollard 640. As shown, the bollard 640 is bisected along its center, with the line-passing through-hole 644 arranged on a first half 712 and a defined path 646 located along a portion of the second half 714.

The first open end 704 is configured to receive a portion of the line on an anchor side. In one example, the line is coupled to an anchor, where the anchor is an object which is stationary and may not move if a user hangs or pulls therefrom. An anchor side herein may refer to a top side and/or top opening of the pocket 614. The first open end 704 may comprise a rounded pocket that bevels an edge of the first open end 704 toward the handle end 630 of the device 610. In this way, the first open end 704 may be at least partially contoured and is not exactly circular. Specifically, the first open end 704 comprises a substantially orthogonal pocket, with an edge of the pocket relieved toward the handle end 630 of the device 610. In one example, the pocket is convex relative to the line-passing through-hole 644. The rounded pocket may be sized according to a desired magnitude of an overturning moment of the bollard 640 resulting from friction being applied to the device 610. For example, when the rounded pocket is larger, then the desired magnitude of the overturning moment decreases, which results in a lesser amount of friction being applied to the line. In some examples, the pocket is cut perpendicular to an axis of the line-passing through-hole 644, which is parallel to the y-axis. A depth of the cut adjusts a moment arm generated by a tensioned anchor line contacting the bollard 640 in relation to the bollard pin (e.g., bollard pin 642). The tension is administered to the device 610 by the line, coupled to the anchor, passing through the bollard 640 and a tether (e.g., tether 622) being coupled to a user hanging from the device 610.

The second open end 706 is configured to feed the line into the defined path 646, as described below in FIG. 7B. As shown, the first open end 704 and the second open end 706 are offset. That is to say, the line-passing through-hole 644 is diagonally arranged such that the first open end 704 is closer to the tether end 620 than the bollard pin 642 in the auto-lock orientation. As such, the line is forced to at least slightly bend upon entering the line-passing through-hole 644 as it passes through the bollard 640. This arrangement may ensure that a moment is generated through a movement range of the handle 632 between an auto-lock mode and a descent mode, as described below. When the handle 632 is rotated beyond the range of angles between the line and the handle 632 comprising the descent mode, the moment reverses direction, causing the bollard 640 to rotate towards the tether end 620 and relieving any pinch between the bollard 640 and the handle 632.

Figure 7B:
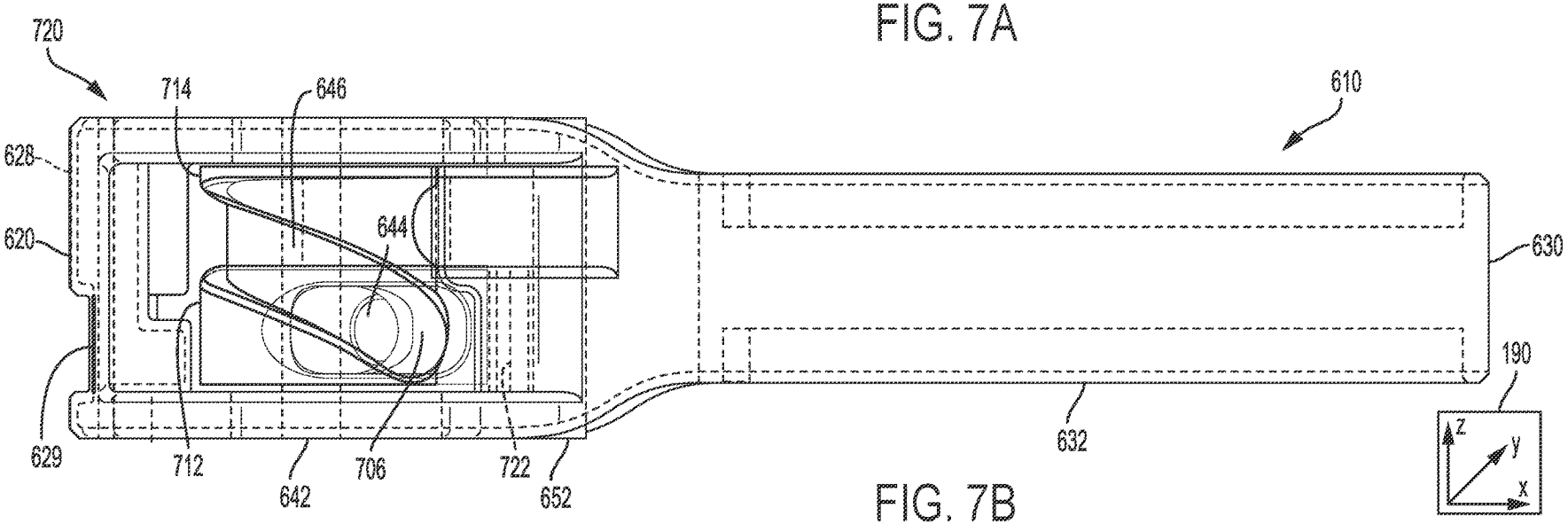

Turning now to FIG. 7B, it shows a bottom-up view 720 of the device 610. In the down-top view 720, the second open end 706 is depicted comprising defined path 646 leading from the second open end 706 on the first half 712 of the bollard 640 and around at least a portion of the second half 714 of the bollard 640. In one example, defined path 646 extends around an entire circumference of the second half 714 of the bollard 640. In another example, the defined path 646 extends at least around 50% of the circumference of the second half 714 of bollard 640. The second open end 706 may be beveled and/or chamfered to smooth a transition between the line-passing through-hole 644 and the defined path 646. In one example, the defined path 646 extends 270° around the bollard 640. It will be appreciated that the defined path 646 may traverse less than or more than 270° without departing from the scope of the present disclosure. The defined path 646 may be a spiral-shaped depression machined into an outer surface of the bollard 640. The defined path 646 is sized such that it is depressed far enough into the bollard 640 such that the line may not fall, slide, and/or wiggle out of the defined path 646. As such, the defined path 646 may comprise raised edges such that the line does not misalign with the defined path 646 following assembly of the device 610 with the line. In one example, the defined path 646 is V-shaped. However, it will be appreciated that the defined path 646 may be other suitable shapes, such as U-shaped, C-shaped, and the like without departing from the scope of the present disclosure. The defined path 646 initially directs the line toward the tether end 620, where the line then wraps around the defined path 646 toward the handle 630. The line exits the device 610 at an area adjacent the handle 632 between the pinch pin 652 and the bollard 640. In one example, a gap 722 located between the bollard 640 and the pinch pin 652 is sized such that the line may snuggly pass therethrough.

Figure 7C:
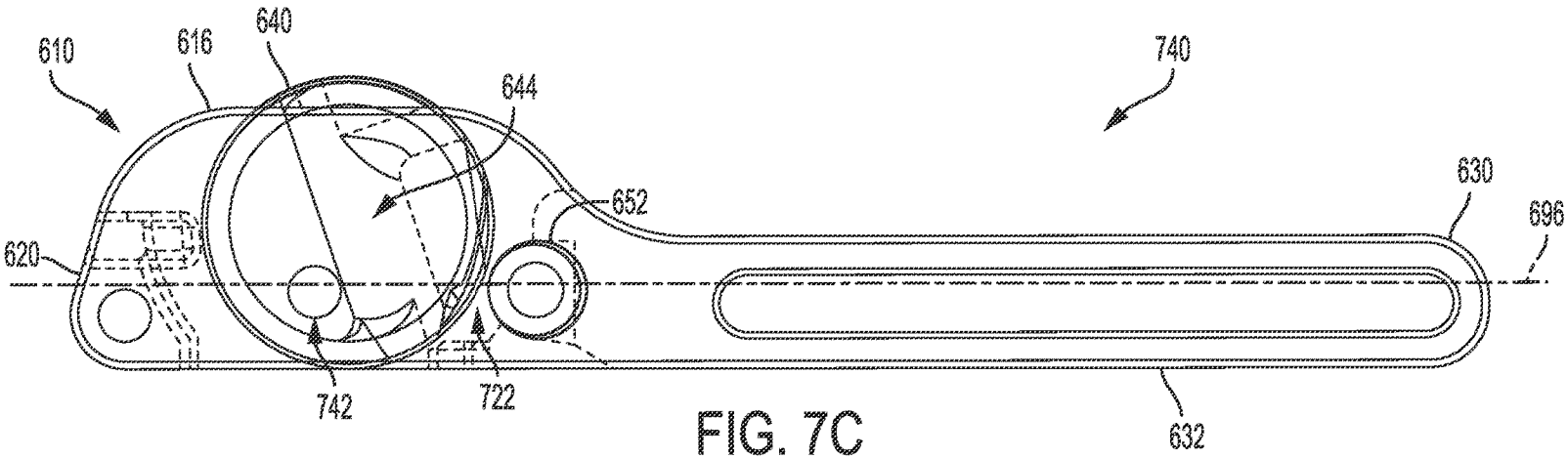

Turning now to FIG. 7C, a cross-sectional view 740 of the bollard 640 is shown. In one example, the cross-sectional view 740 is parallel to the second axis 696 of FIG. 6. A pin receiving hole 742 is arranged adjacent to, but not intersecting, the line-passing through-hole 644. Specifically, the pin receiving hole 742 is oriented perpendicular to the line-passing through-hole 644, and biased towards a periphery of the bollard 640. In the embodiment shown in FIG. 7C, the pin receiving hole 742 is biased towards the periphery of the bollard 640 closer to the tether end 620. By having the pin receiving hole 742 biased towards a periphery of the bollard 640, rotation of the bollard 640 about the bollard pin 642 will be eccentric, and thereby may result in the gap 722 between the bollard 640 and the pinch pin 652 changing in size based on the position of the handle 632 relative to an anchored line. This may enable the angular position of the bollard 640 to adjust an amount of friction exerted on a line passing through gap 722. The pin receiving hole 742 is separate from (does not intersect with) the line-receiving through-hole 644 such that the bollard pin (e.g., bollard pin 642), which passes through the pin receiving hole 742, does not come into contact with the line passing through the line-passing through-hole 644. The bollard pin is fixedly coupled at both extreme ends of the bollard pin 642 such that the bollard pin 642 does not slide out of the pin receiving hole 742. The bollard 640 is configured to at least partially rotate and/or pivot about the bollard pin 642, as such the bollard pin 642 may also be referred to herein as the bollard pivot point. As the bollard 640 rotates, a size of the gap 722 between the pinch pin 652 and the bollard 640 may be adjusted. In one example, the gap 722 increases as the handle 632 is urged toward a tether (e.g., tether 622 of FIG. 6). Additionally, geometries of the bollard 640 impart varying frictional forces onto the line as the bollard 640 is rotated. This may include adjusting one or more bends and/or kinks in the line as it passes through and around the bollard 640, which may adjust a rate of descent and/or payout.

As shown, the line-passing through-hole extends through an entire transect of the bollard 640. This forces the line to enter the bollard 640 above the side walls 616, and exit the bollard 640 at a location adjacent to the bollard pin 642. The line then wraps around greater than 50% of a circumference in the defined path 646 of the bollard 640 before exiting the device 610 in a location adjacent the pinch pin 652.

Figure 7D:
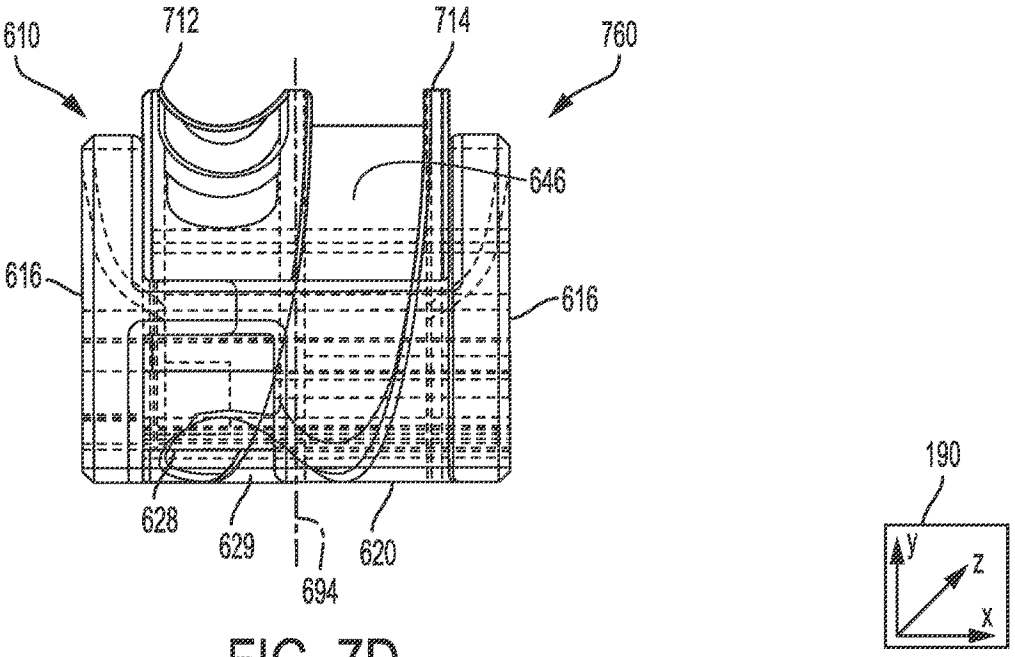

Turning now to FIG. 7D, a perspective view 760 is shown with the tether end 620 of the device 610 facing a viewer. The perspective view 760 looks down the second axis of the device 610 adjacent the tether end 620. The defined path 646 is shown extending from the first half 712 from a location at a bottom of the bollard 640 to the second half 714, where the defined path 646 wraps at least partially around the second half 714 of the bollard 640. Thus, in the example of FIG. 7D, the line enters the bollard 640 in a direction parallel to the first axis 694, passes through the line-passing through-hole of the bollard 640, extends toward the tether end 620 of the device 610, and continues to wrap around the defined path 646 toward the handle end, where the line passes adjacent to the point at which the line entered the bollard 640, and through the gap located between the bollard 640 and the pinch pin 652. It will be appreciated that the line may enter the bollard 640 in a variety of directions, which may be dependent on one or more of a position of the user and an actuation of the handle (e.g., handle 632).

In this way, a device configured to assist a user in egressing from a building is shown. The device comprises a bollard capable of gradually adjusting one or more forces applied to the line based on an actuation of the device. The device rotates when a user pulls on a handle of the device toward their body. The technical effect of actuating the device is to adjust a bend of the line through the device or a pinching between the bollard and a pinch pin of the line to alter a friction applied to the line. This may enable a user to egress from a building, cliff, etc. Further, the rappelling mechanism herein disclosed enables a more even application of frictional forces to a line, thereby reducing the maximum pressure applied to the line by the rappelling mechanism. The technical effect of reducing the maximum pressure exerted on a line by exerting the same total force over a larger area of line is to reduce the maximum force exerted by a rappelling mechanism on a line, and thereby reduce the damage done to the line as it passes through a rappelling mechanism.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising: a body comprising a handle and a pocket, wherein a pivotable bollard is located in the pocket, the bollard comprising an outer surface wherein a defined path for a line wraps around more than half a circumference of the bollard from a beginning to an end of the defined path on the bollard, the defined path includes a second open end of a line-passing through-hole at a bottom of the bollard and the line-passing through-hole passes through the bollard to a first open end at a top of the bollard, the second open end of the line-passing through-hole located adjacent to the defined path, and wherein the bollard pivots around a pin having a rotation axis, the beginning of the defined path offset along the rotation axis with respect to the end of the defined path.

2. The system of claim 1, wherein the pin extends through a pin receiving hole of the bollard, wherein the pin receiving hole does not intersect with the line-passing through-hole, and wherein the pin receiving hole is arranged proximally to a periphery of the bollard.

3. The system of claim 1, wherein the pocket is proximal to a tether end of the body and distal to a handle end of the body.

4. A rappelling device, comprising:

a body having a handle end opposite a tether end with a pocket arranged adjacent the tether end;

a bollard having a kidney shape arranged in the pocket and configured to pivot about a bollard pivot pin, wherein the kidney shape comprises two lobes;

a line-passing through-hole transecting the bollard and comprising a first open end and a second open end, where the first open end is open to the pocket and where the second open end is located on a defined path extending at least partially around an outer perimeter of the bollard, wherein the bollard pivots around a pin having a rotation axis, a beginning of the defined path offset along the rotation axis with respect to an end of the defined path; and a handle extending from the pocket to the handle end configured to rotate the body about the bollard pivot pin.

5. The rappelling device of claim 4, wherein the bollard applies a first amount of friction to a line at the first open end of the line-passing through-hole, a second amount of friction to the line in the defined path, and a third amount of friction at a space between the bollard and a pinch pin.

6. The rappelling device of claim 4, wherein the defined path leads to a gap arranged between the bollard and a tether end surface or between the bollard and the pinch pin within a portion of the pocket, further comprising a stop feature which, as the bollard moves, may adjust one or more of:

a size of the gap;

a pivoting range of the bollard toward and away from the tether end;

friction between the bollard, a line passing through the line-passing through-hole, and the tether end surface; and a drag force.

7. The rappelling device of claim 4, wherein the handle generates friction proximal to a tether end surface between the tether end surface, a line passing through the line-passing through-hole, and the bollard in response to an actuation of the handle beyond a threshold.

8. The rappelling device of claim 4, further comprising an alignment eye located in the handle of the rappelling device, and aligned with the defined path of the bollard.

9. A system, comprising: a body comprising a handle and a pocket, wherein a pivotable bollard is located in the pocket, the bollard comprising an outer surface wherein a defined path for a line wraps around more than half a circumference of the bollard from a beginning to an end of the defined path on the bollard, the defined path including extending from a second open end of a line-passing through-hole at a bottom of the bollard and through the bollard to a first open end at a top of the bollard, the defined path further extending along the top of the bollard, wherein the bollard pivots around a pin having a rotation axis, and wherein the first open end of the line-passing through-hole is offset along the rotation axis with respect to the second open end of the line-passing through-hole; and the beginning of the defined path offset along the rotation axis with respect to the end of the defined path.

10. The system of claim 9 wherein the body further comprises a cutout adjacent the pocket, the cutout including a tether pin.

11. The system of claim 10 wherein the body further comprises a pinch pin adjacent the handle.

12. The system of claim 11, wherein the system is configured to receive the line passing from the pinch pin, around the bollard, into the second open end, through the through-hole, and out the first open end.

* * * * *